US011355885B2

(12) United States Patent
Sekino

(10) Patent No.: US 11,355,885 B2
(45) Date of Patent: Jun. 7, 2022

(54) CONNECTOR CONFIGURED TO REGULATE MOVEMENT RELATIVE TO WALL PART

(71) Applicant: Yazaki Corporation, Tokyo (JP)

(72) Inventor: Tetsuya Sekino, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 17/146,446

(22) Filed: Jan. 11, 2021

(65) Prior Publication Data

US 2021/0218180 A1 Jul. 15, 2021

(30) Foreign Application Priority Data

Jan. 15, 2020 (JP) ..... JP2020-004221

(51) Int. Cl.

| | |
|---|---|
| ***H01R 13/46*** | (2006.01) |
| ***H01R 13/52*** | (2006.01) |
| ***H01R 13/512*** | (2006.01) |
| ***H01R 13/518*** | (2006.01) |
| ***H01R 13/631*** | (2006.01) |
| ***H01R 13/74*** | (2006.01) |

(52) U.S. Cl.

CPC ..... *H01R 13/521* (2013.01); *H01R 13/512* (2013.01); *H01R 13/518* (2013.01); *H01R 13/6315* (2013.01); *H01R 13/74* (2013.01)

(58) Field of Classification Search

CPC .. H01R 13/521; H01R 13/512; H01R 13/518; H01R 13/6315; H01R 13/74; H01R 13/5202; H01R 13/46

USPC ..... 439/587, 271

See application file for complete search history.

(56) References Cited

U.S. PATENT DOCUMENTS

| | | | | |
|---|---|---|---|---|
| 5,947,766 | A * | 9/1999 | Tsuji | H01R 13/748 439/559 |
| 6,113,424 | A * | 9/2000 | Shinozaki | H01R 13/5202 439/556 |
| 6,953,357 | B2 * | 10/2005 | Fukushima | H01R 13/5219 439/271 |
| 7,094,098 | B2 * | 8/2006 | Miyazaki | H01R 4/46 439/550 |
| 7,097,498 | B2 * | 8/2006 | Miyazaki | H01R 4/46 439/362 |

(Continued)

FOREIGN PATENT DOCUMENTS

| | | |
|---|---|---|
| EP | 2 882 045 A1 | 6/2015 |
| JP | 2013-131473 A | 7/2013 |

(Continued)

*Primary Examiner* — Harshad C Patel
(74) *Attorney, Agent, or Firm* — Kenealy Vaidya LLP

(57) ABSTRACT

A connector can include a bolt, a housing, a sealing member, and a holder. The housing can include a fixing part having a through hole into which the bolt is inserted, and an inserting part. The fixing part can be fixed to a wall part by the bolt and the inserting part can have a tubular shape that projects from the fixing part to be inserted into a hole part of the wall part. The sealing member can be mounted on an outer surface of the inserting part to seal between the inserting part and the hole part. The holder can include an abutting part that is positioned between an outer surface of the inserting part and the hole part, and the holder can be fixed to a distal end part of the inserting part.

10 Claims, 22 Drawing Sheets

(56) References Cited

U.S. PATENT DOCUMENTS

| | | | | |
|---|---|---|---|---|
| 7,621,777 | B2 * | 11/2009 | Thelen | H01R 13/748 439/544 |
| 8,262,413 | B2 * | 9/2012 | Fujiwara | H01R 13/6596 439/607.28 |
| 9,017,099 | B2 * | 4/2015 | Ikeda | H01R 13/521 439/559 |
| 9,502,812 | B2 * | 11/2016 | Akagi | H01R 13/73 |
| 10,630,021 | B2 * | 4/2020 | Shiraishi | H01R 13/6315 |
| 10,734,757 | B2 * | 8/2020 | Westerfield | H01R 13/533 |
| 2002/0031949 | A1 * | 3/2002 | Miyazaki | H01R 13/5202 439/625 |
| 2002/0155756 | A1 * | 10/2002 | Yoshioka | H01R 13/648 439/607.01 |
| 2003/0207641 | A1 * | 11/2003 | Quick | D21H 15/02 442/413 |
| 2009/0124121 | A1 * | 5/2009 | Matsuoka | H01R 13/5202 439/550 |
| 2011/0230086 | A1 * | 9/2011 | Fujiwara | H01R 13/6584 439/559 |
| 2014/0302711 | A1 | 10/2014 | Suzuki et al. | |
| 2015/0099385 | A1 * | 4/2015 | Ikeya | H01R 12/724 439/271 |
| 2015/0140851 | A1 | 5/2015 | Wang | |
| 2015/0207263 | A1 * | 7/2015 | Fabre | H01R 13/506 439/271 |
| 2015/0372413 | A1 * | 12/2015 | Kataoka | H01R 13/5219 439/271 |
| 2019/0237899 | A1 | 8/2019 | Makino | |
| 2020/0288595 | A1 | 9/2020 | Kawai | |
| 2021/0013655 | A1 | 1/2021 | Ono et al. | |

FOREIGN PATENT DOCUMENTS

| | | | |
|---|---|---|---|
| JP | 2015-11946 | A | 1/2015 |
| WO | 2013/094774 | A1 | 6/2013 |
| WO | 2019/097952 | A1 | 5/2019 |
| WO | 2019/193992 | A1 | 10/2019 |

* cited by examiner

CONNECTOR CONFIGURED TO REGULATE MOVEMENT RELATIVE TO WALL PART

CROSS-REFERENCE TO RELATED APPLICATION(S)

The present application claims priority to and incorporates by reference the entire contents of Japanese Patent Application No. 2020-004221 filed in Japan on Jan. 15, 2020.

BACKGROUND OF THE INVENTION

1. Field of the Invention

The present invention relates to a connector.

2. Description of the Related Art

In the related art, there is known a connector that is fixed to a hole part of a housing and the like. Japanese Patent Application Laid-open No. 2015-11946 discloses a shield connector that includes a harness side connector and an appliance side connector, and electrically connects an electric appliance with a wire harness by fixing the appliance side connector to a unit case in which the electric appliance is housed and connecting the appliance side connector with the harness side connector.

In the shield connector disclosed in Japanese Patent Application Laid-open No. 2015-11946, the appliance side connector is inserted into an opening part of the unit case to be fixed to the unit case by a bolt.

In a connector including an inserting part to be inserted into a hole part, a sealing member may be provided for sealing between the inserting part and the hole part. In this case, it is preferable to suppress deterioration of sealing performance of the sealing member. For example, if eccentricity of the inserting part with respect to the hole part is suppressed, deterioration of sealing performance of the sealing member is suppressed.

SUMMARY OF THE INVENTION

It is an object of the present invention to provide a connector that can suppress deterioration of sealing performance of the sealing member.

A connector according to one aspect of the present invention includes a bolt; a housing including a fixing part having a through hole into which the bolt is inserted, the fixing part being fixed to a wall part by the bolt, and an inserting part having a tubular shape that projects from the fixing part to be inserted into a hole part of the wall part; a sealing member that is mounted on an outer surface of the inserting part to seal between the inserting part and the hole part; and a holder including an abutting part that is positioned between an outer surface of the inserting part and the hole part, the holder being fixed to a distal end part of the inserting part, wherein the abutting part abuts on a wall surface of the hole part so as to limit relative movement of the inserting part with respect to the hole part, and a gap between the wall surface of the hole part and the abutting part is narrower than a gap between a wall surface of the through hole and the bolt.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

The following describes a connector according to an embodiment of the present invention in detail with reference to the drawings. The present invention is not limited to the embodiment. Constituent elements in the embodiment described below include a constituent element that is easily conceivable by those skilled in the art, or substantially the same constituent element.

Embodiment

Figure 1:
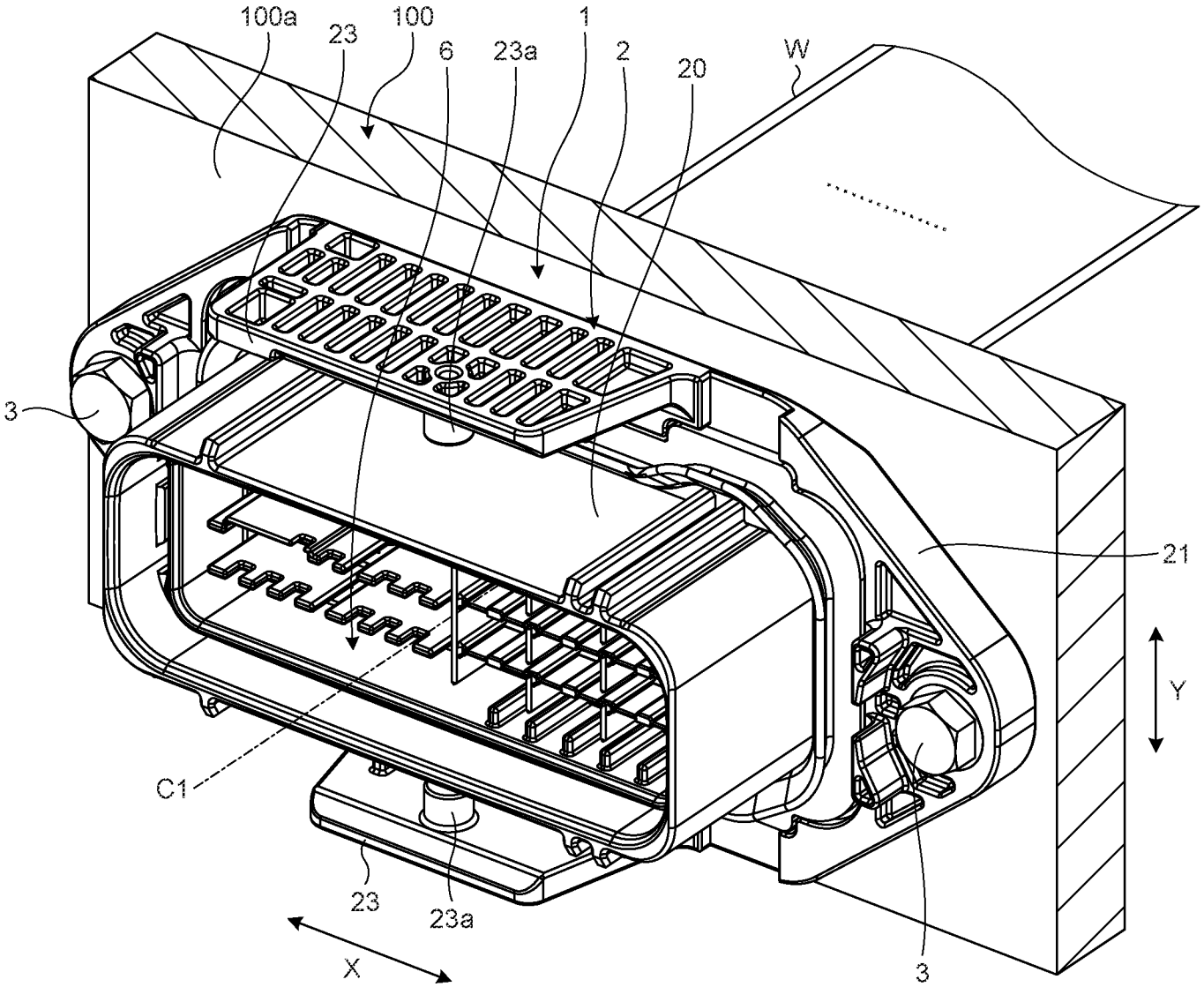
FIG. 1 is a perspective view illustrating a connector according to an embodiment.
Figure 3:
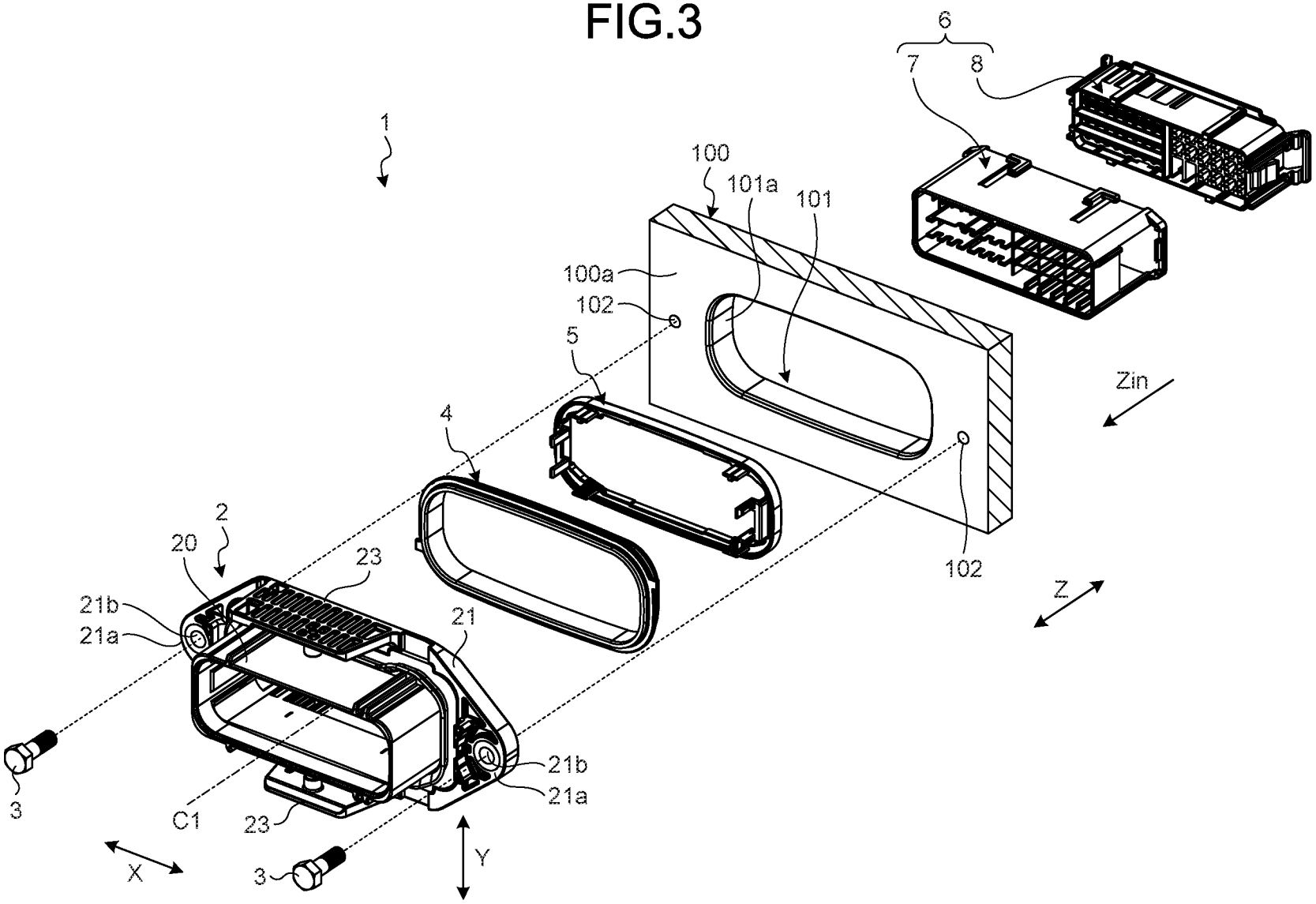
FIG. 3 is an exploded perspective view of the connector according to the embodiment.
Figure 4:
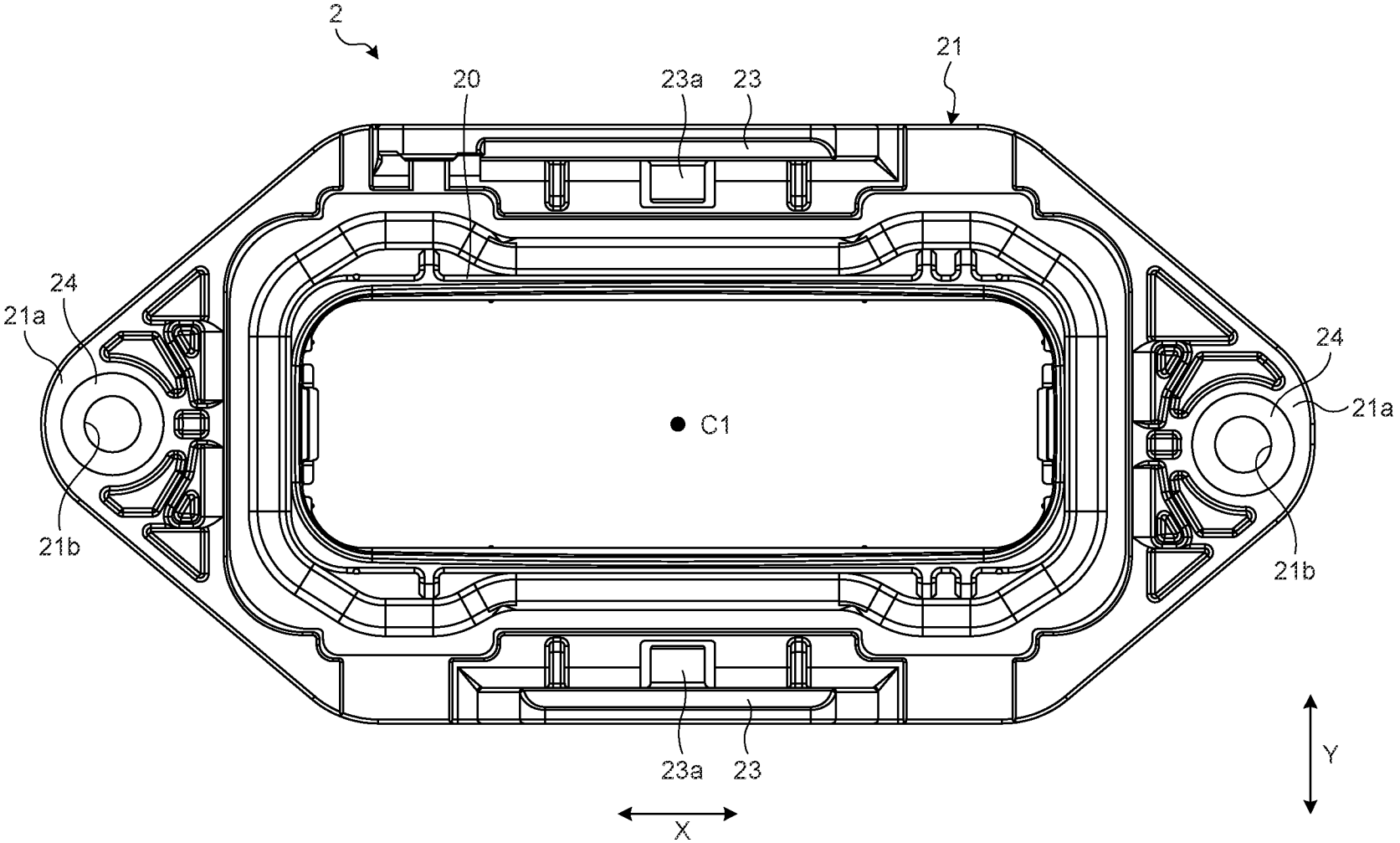
FIG. 4 is a front view of the outer housing according to the embodiment.
Figure 5:
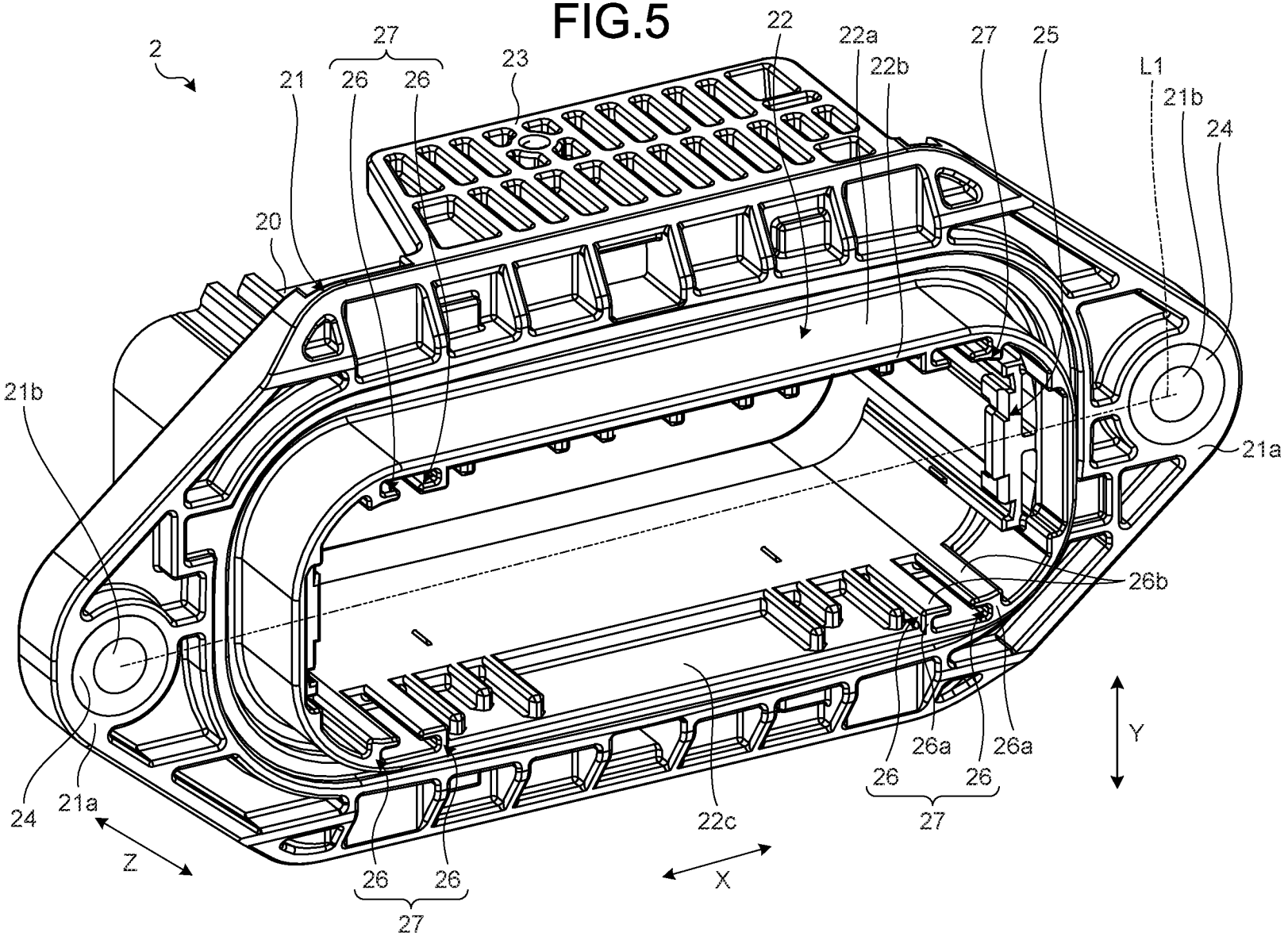
FIG. 5 is a perspective view of the outer housing according to the embodiment.
Figure 6:
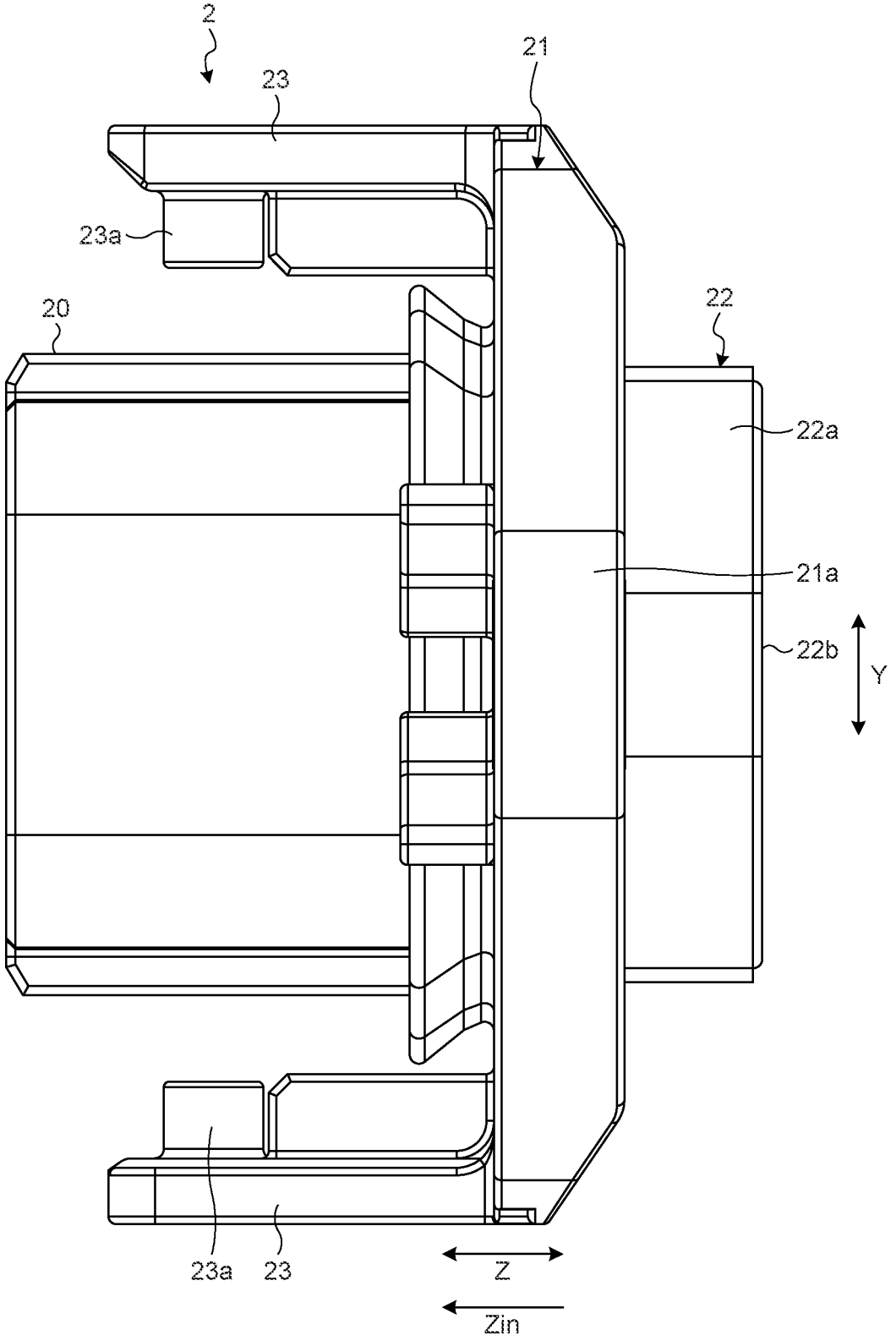
FIG. 6 is a side view of the outer housing according to the embodiment.
Figure 7:
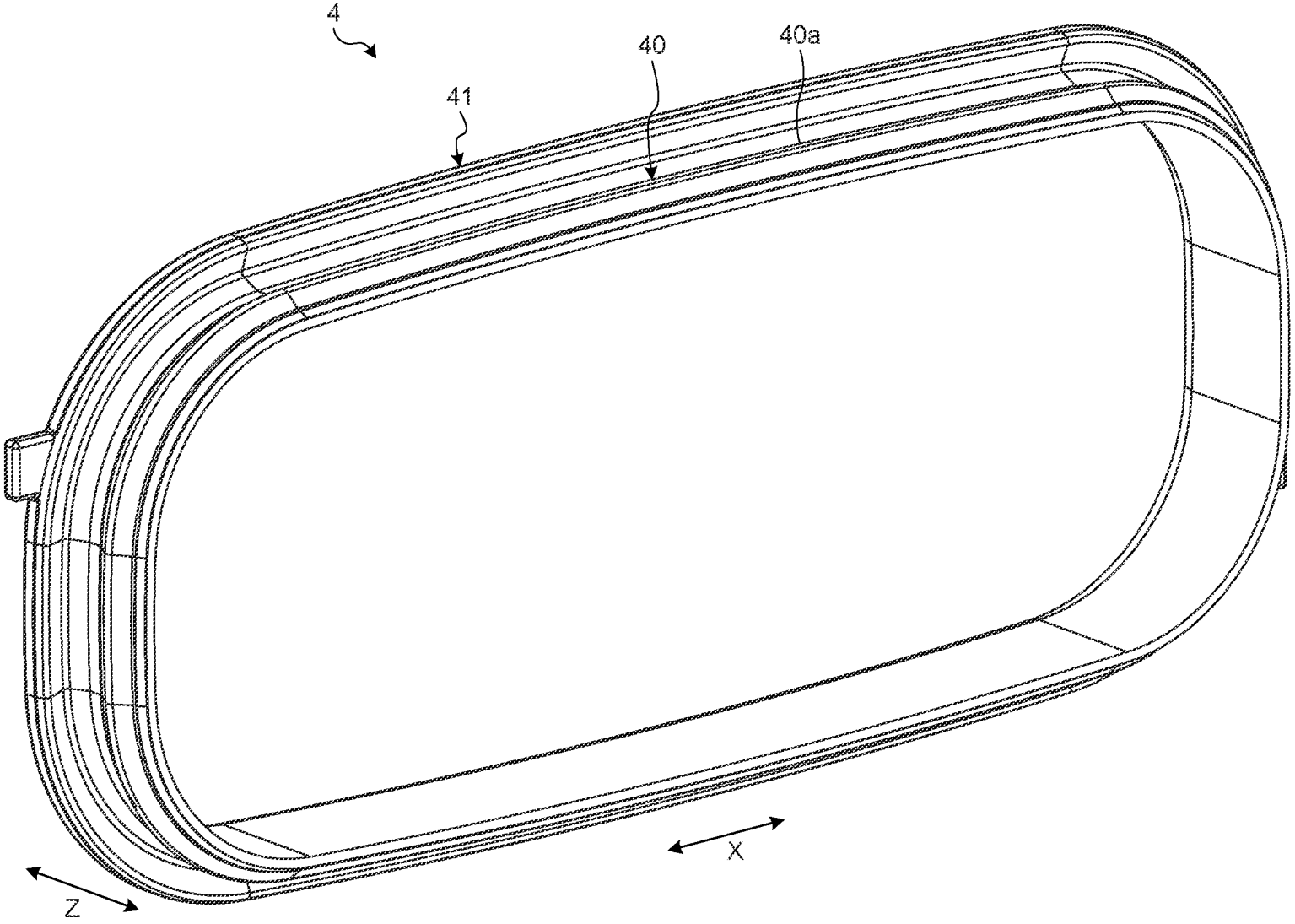
FIG. 7 is a perspective view of a sealing member according to the embodiment.
Figure 8:
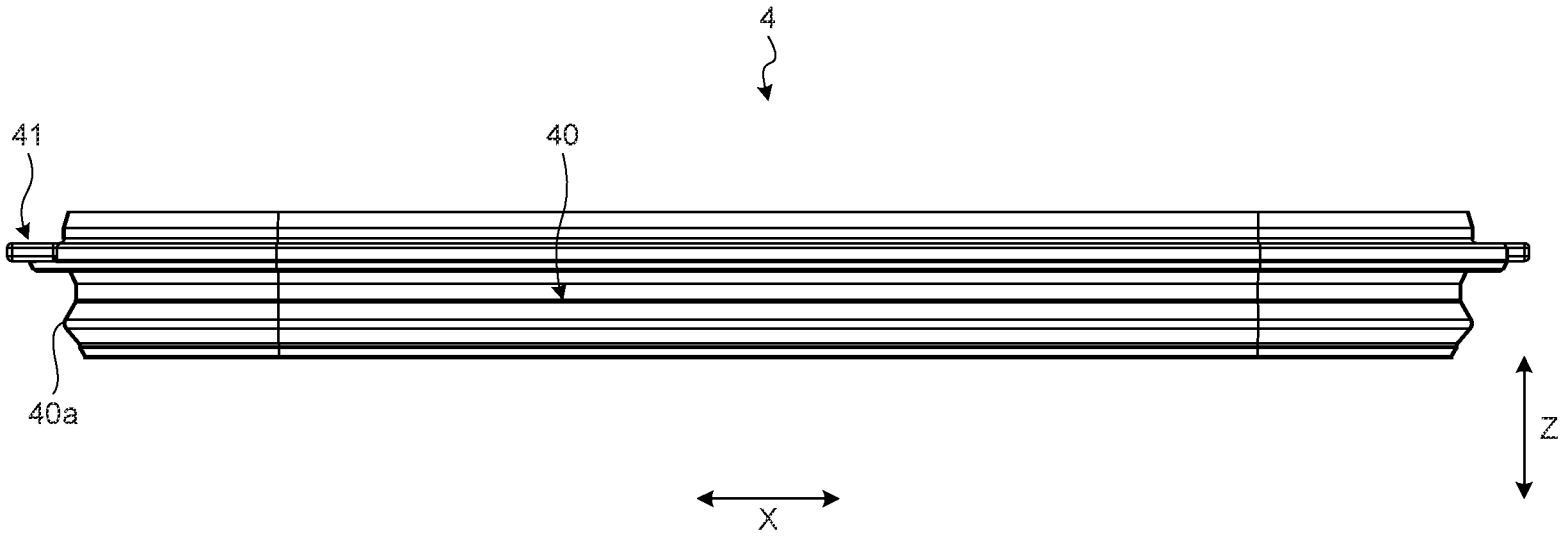
FIG. 8 is a side view of the sealing member according to the embodiment.
Figure 9:
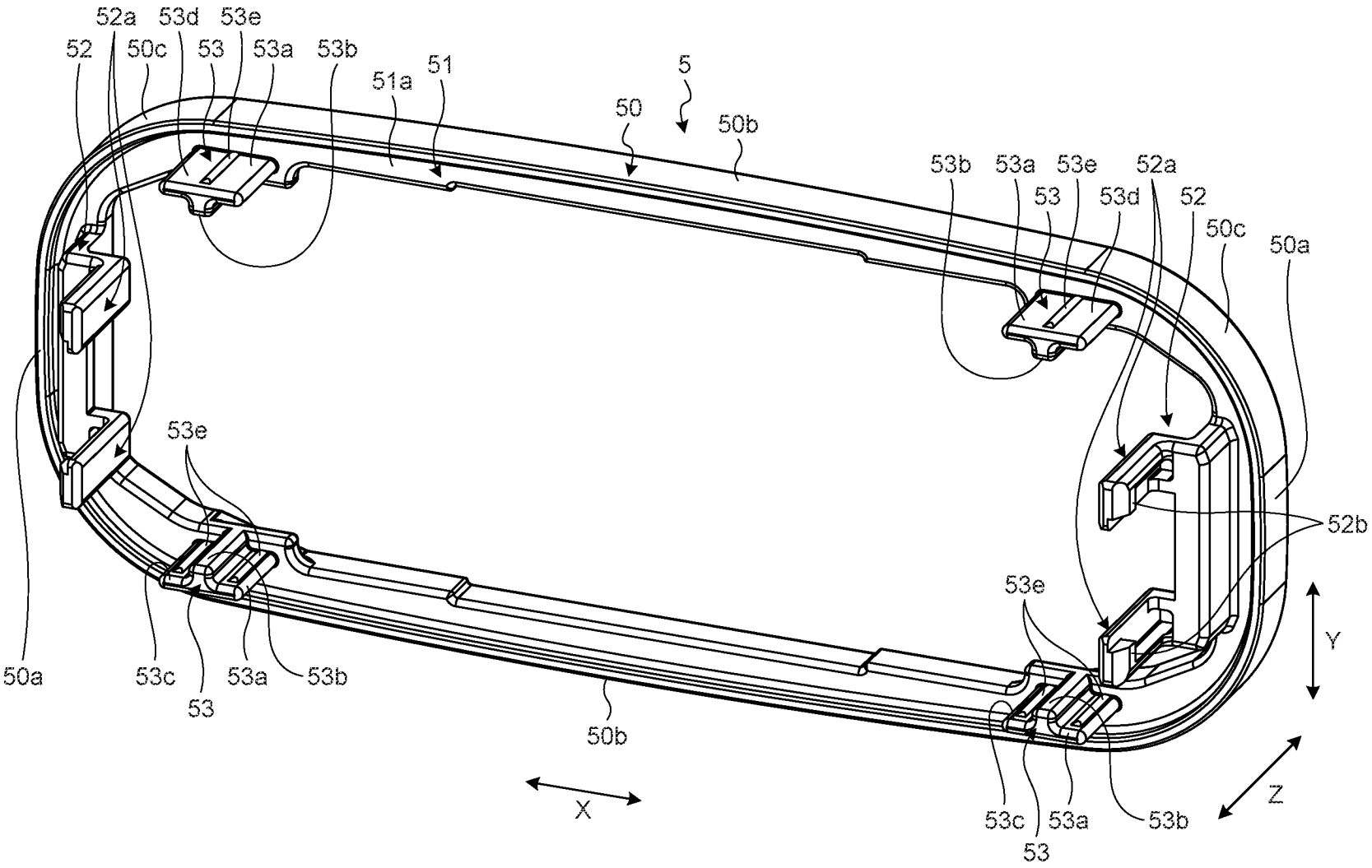
FIG. 9 is a perspective view of a holder according to the embodiment.
Figure 10:
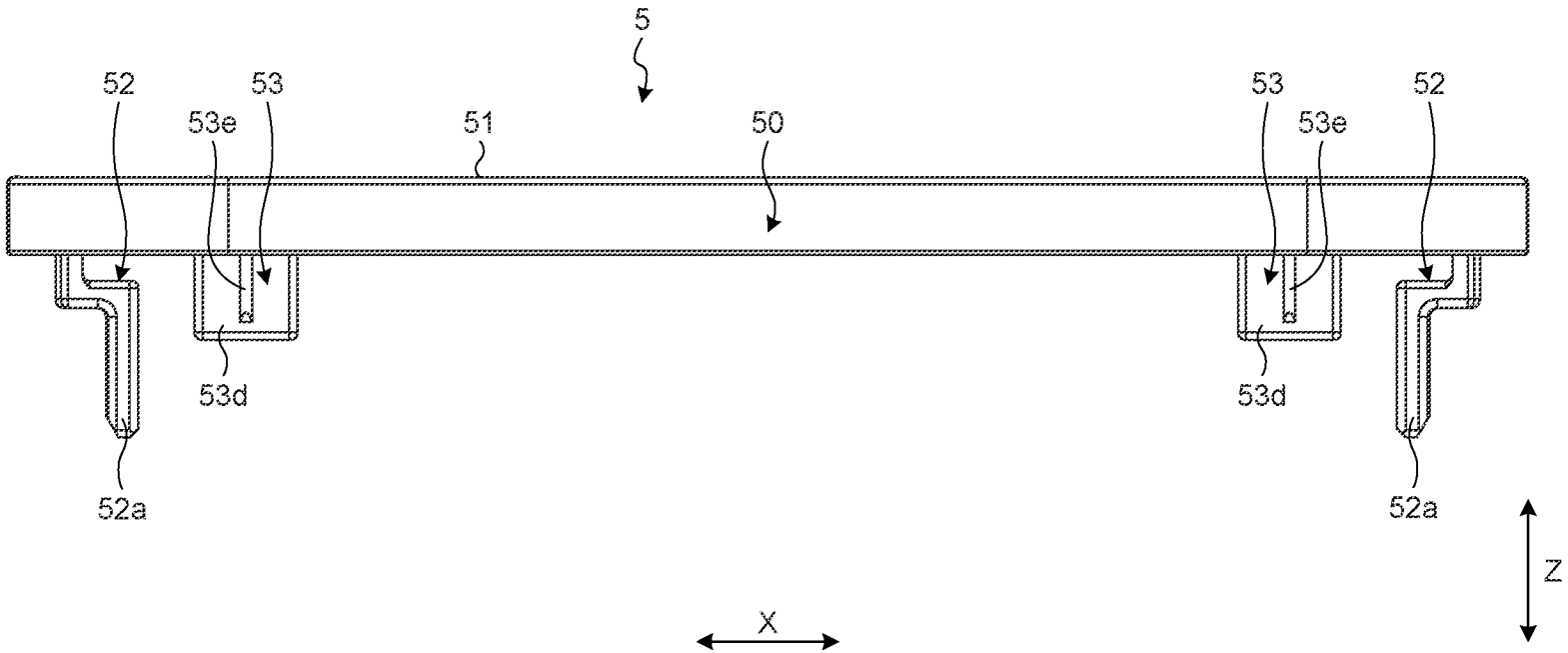
FIG. 10 is a side view of the holder according to the embodiment.

The following describes the embodiment with reference to FIG. 1 to FIG. 22. The present embodiment relates to a connector. FIG. 1 is a perspective view illustrating the connector according to the embodiment, FIG. 2 is a diagram illustrating an inner housing to be inserted into an outer housing, FIG. 3 is an exploded perspective view of the connector according to the embodiment, FIG. 4 is a front view of the outer housing according to the embodiment, FIG. 5 is a perspective view of the outer housing according to the embodiment, FIG. 6 is a side view of the outer housing according to the embodiment, FIG. 7 is a perspective view of a sealing member according to the embodiment, FIG. 8 is a side view of the sealing member according to the embodiment, FIG. 9 is a perspective view of a holder according to the embodiment, and FIG. 10 is a side view of the holder according to the embodiment.

Figure 11:
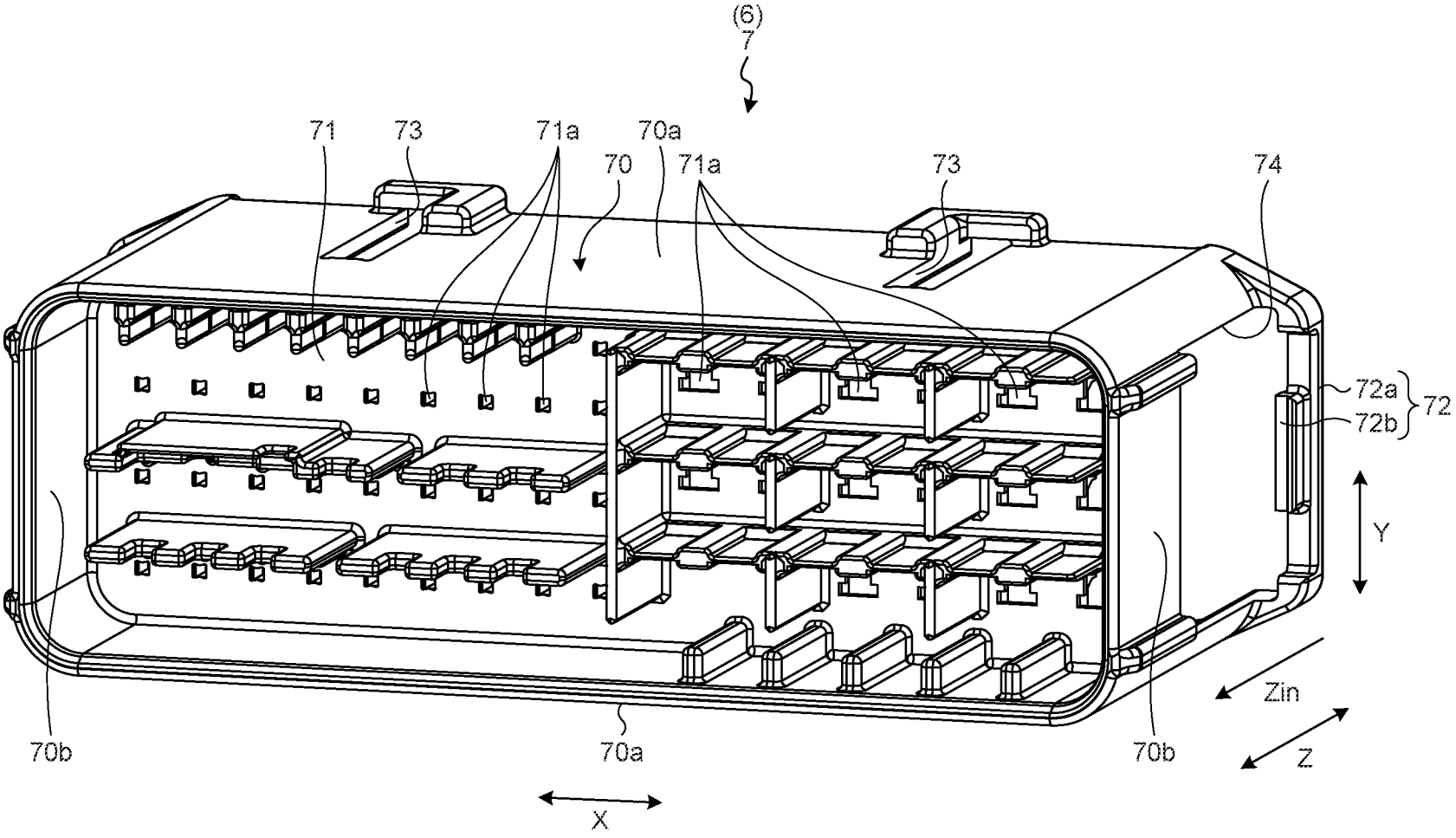
FIG. 11 is a perspective view of an outer shell part of the inner housing according to the embodiment.
Figure 12:
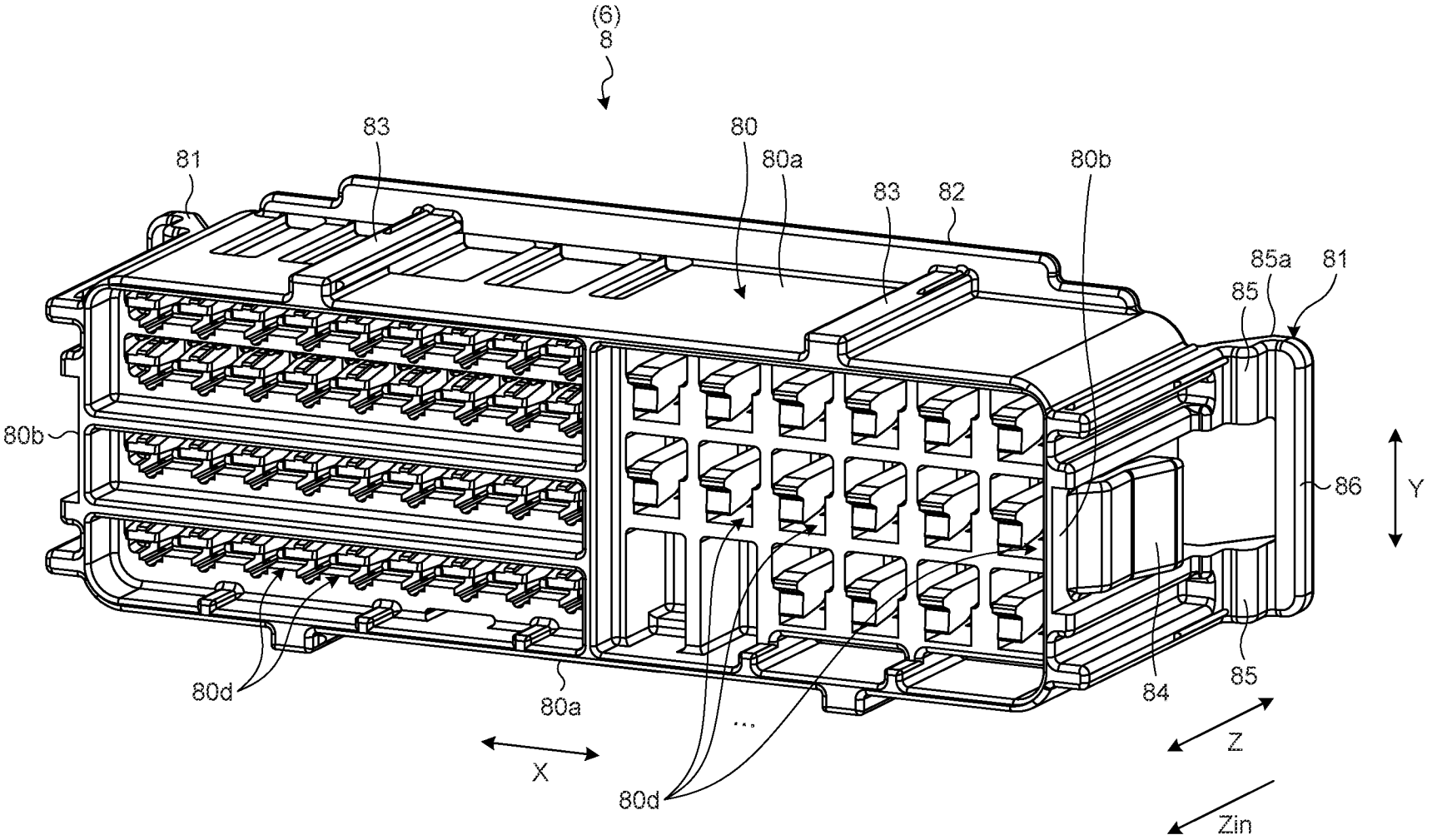
FIG. 12 is a perspective view of a holding body of the inner housing according to the embodiment.
Figure 13:
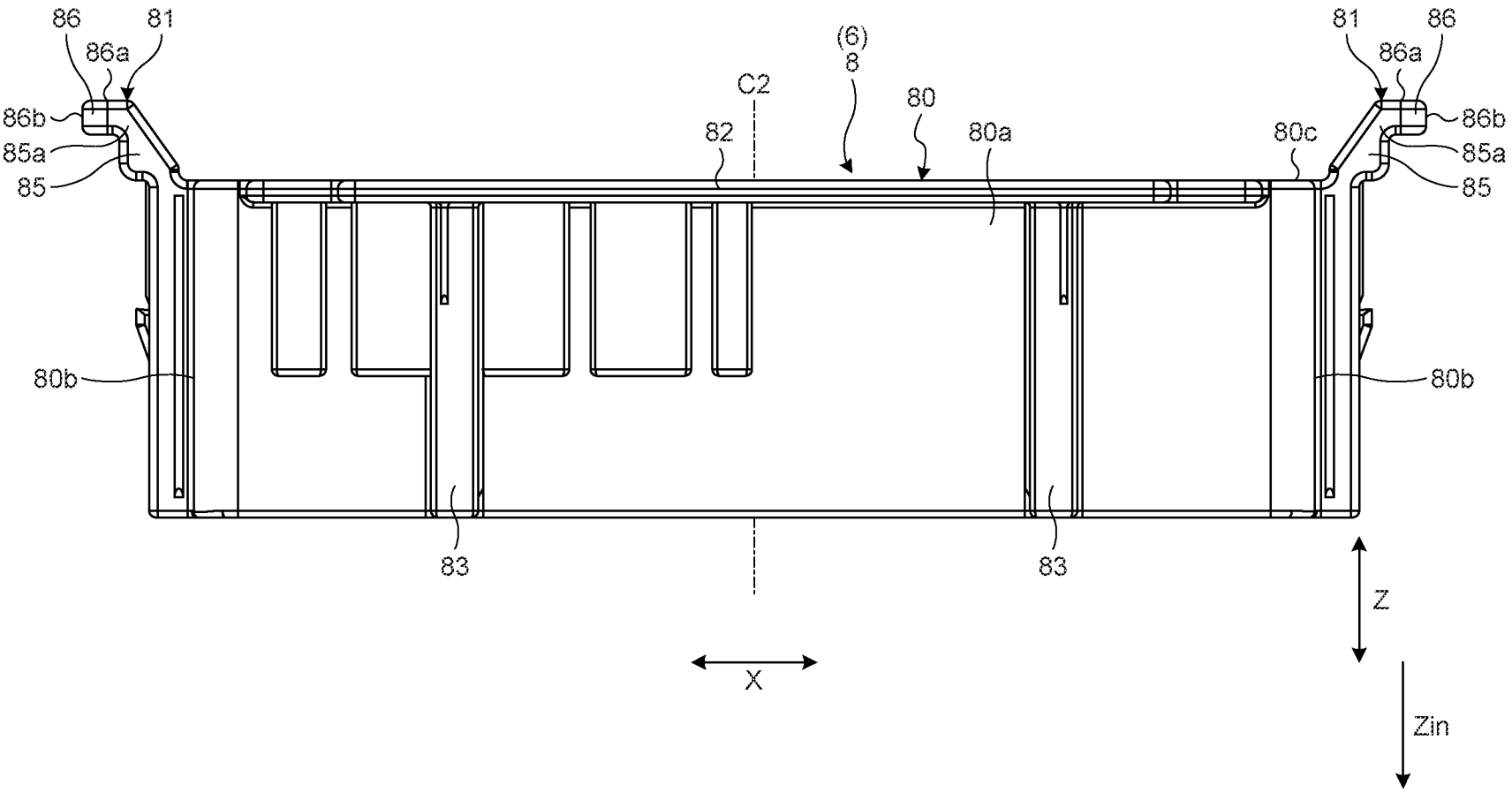
FIG. 13 is a plan view of the holding body according to the embodiment.
Figure 14:
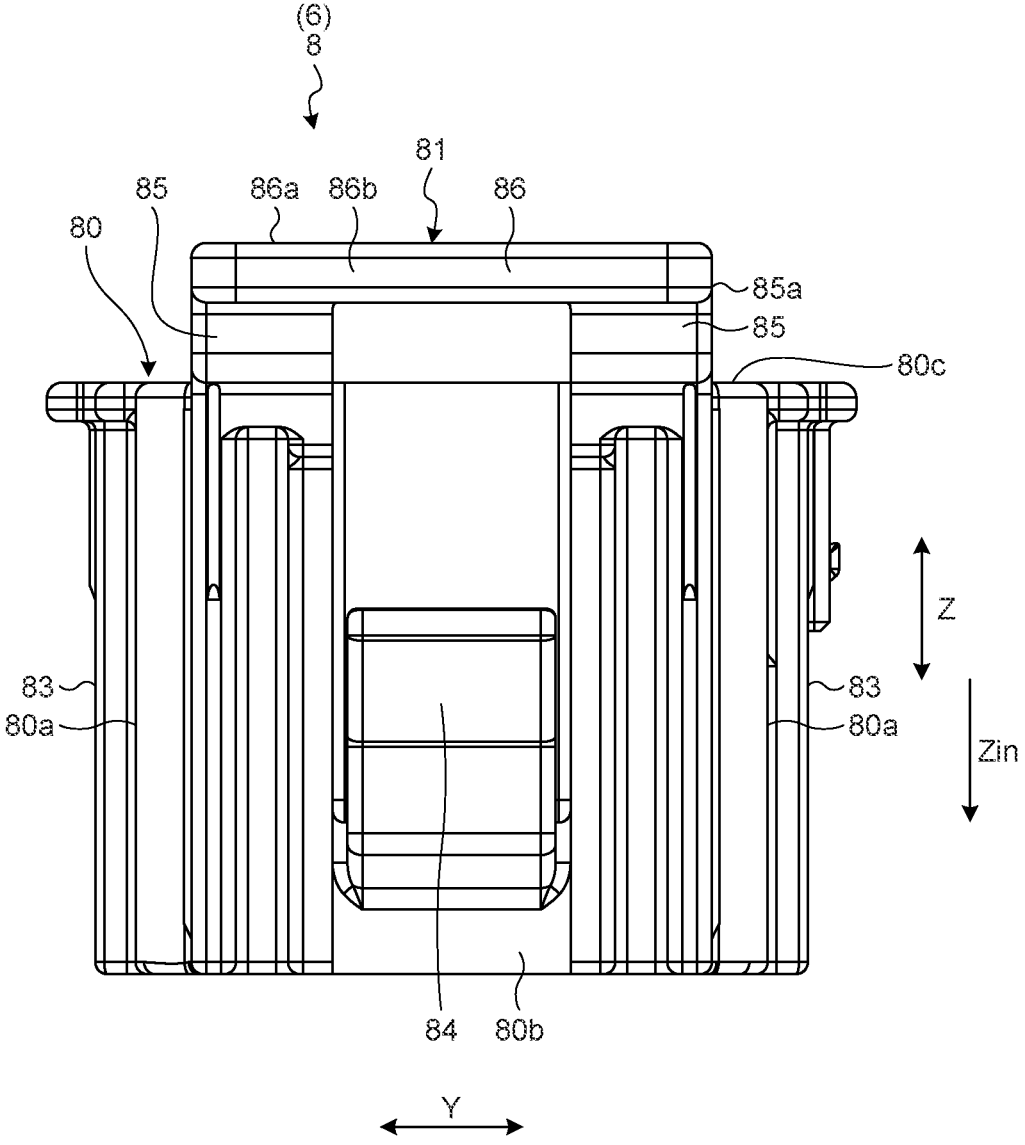
FIG. 14 is a side view of the holding body according to the embodiment.
Figure 15:
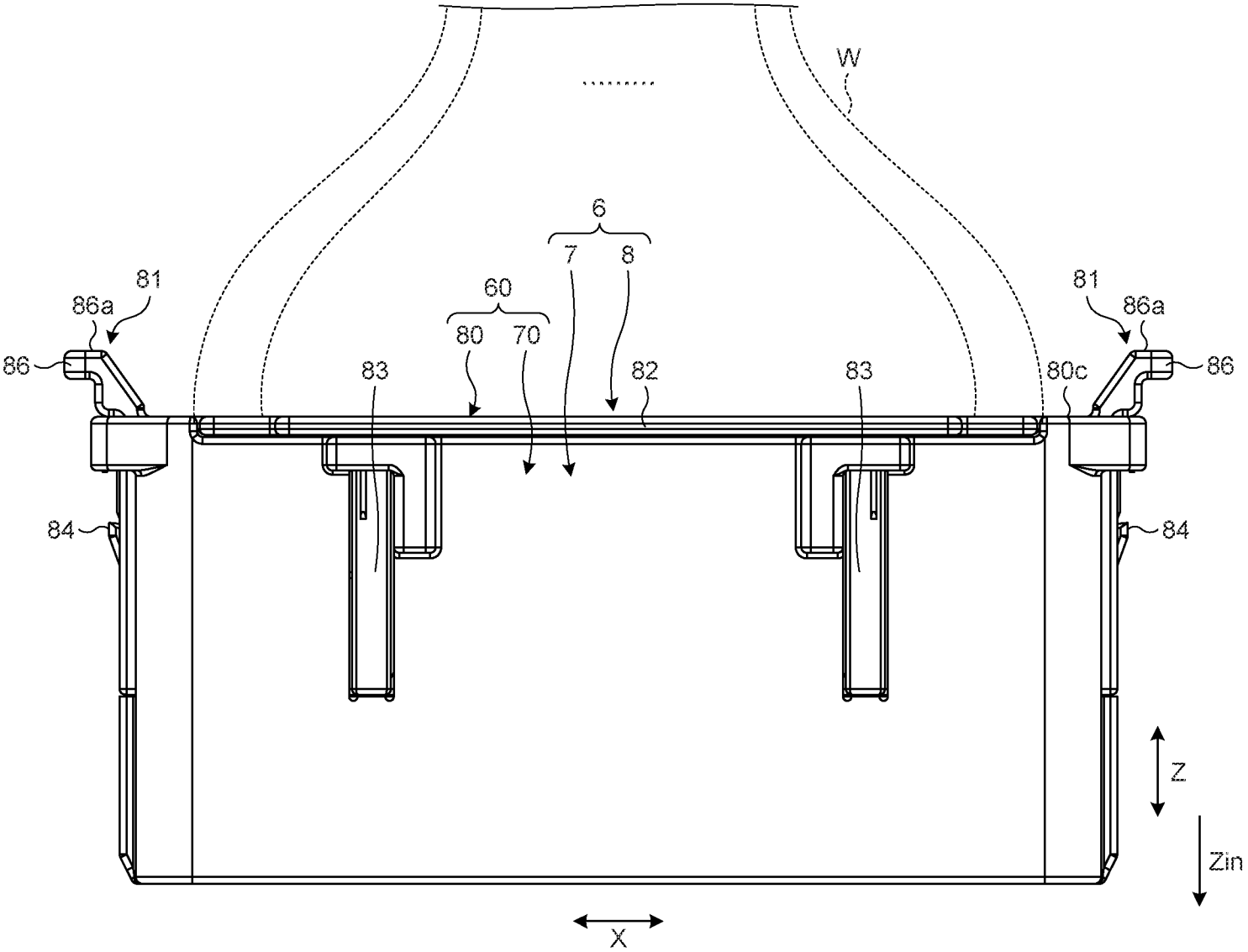
FIG. 15 is a plan view of the inner housing according to the embodiment.
Figure 16:
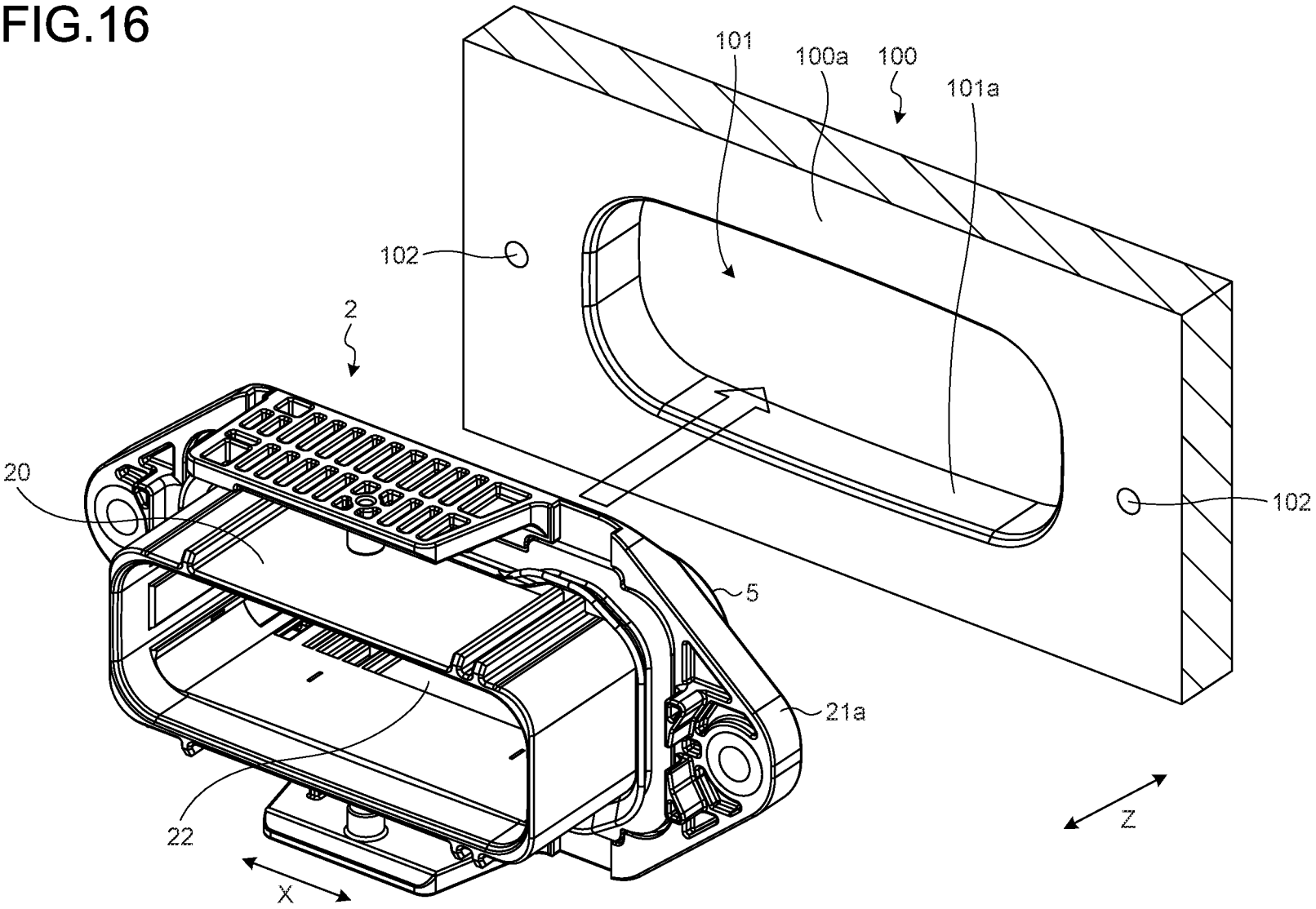
FIG. 16 is a perspective view illustrating the outer housing to be inserted into a hole part.
Figure 17:
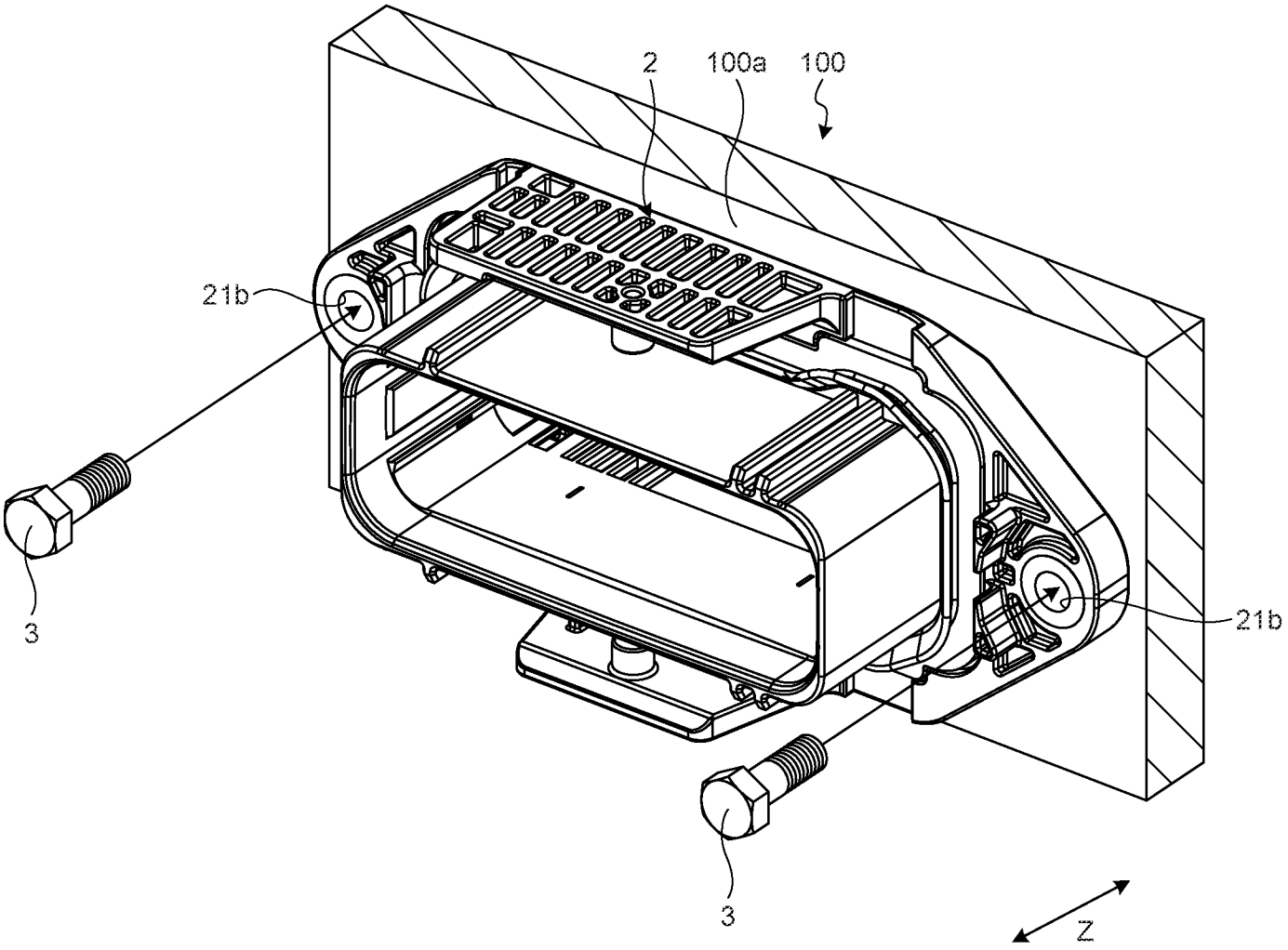
FIG. 17 is a perspective view illustrating fastening of bolts to a wall part.
Figure 18:
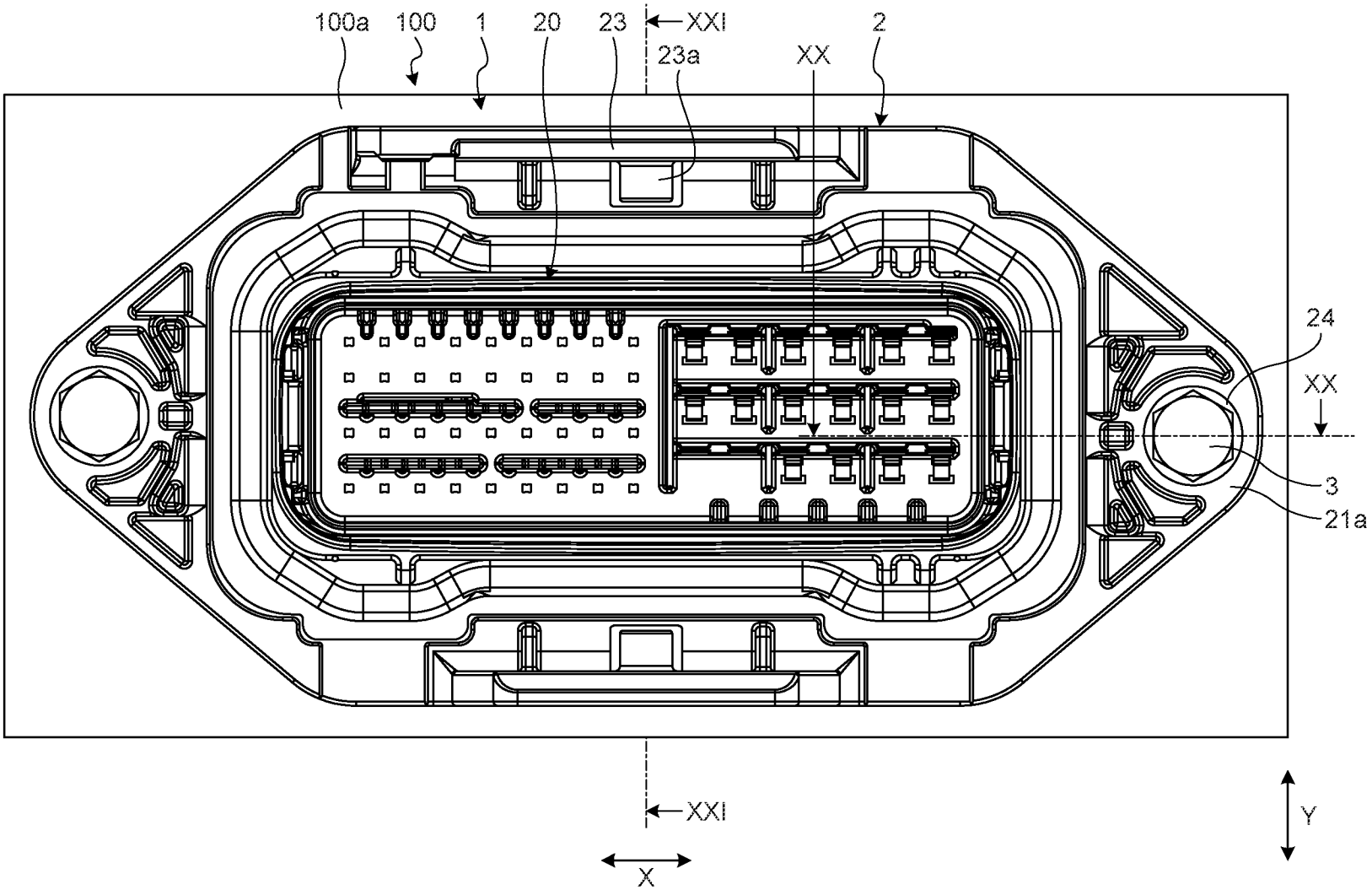
FIG. 18 is a front view illustrating the outer housing fixed to the wall part.
Figure 19:
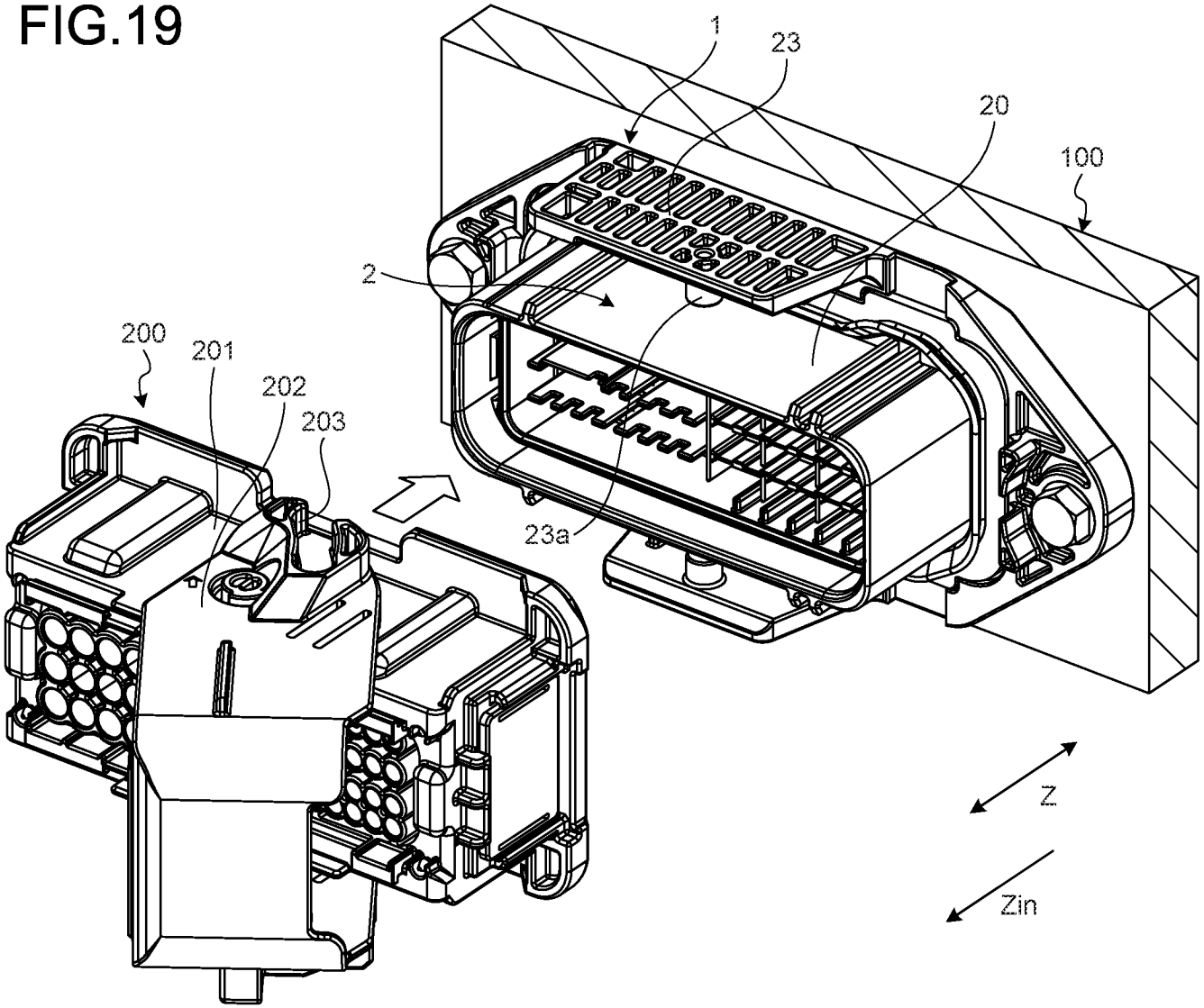
FIG. 19 is a perspective view illustrating a counterpart connector to be connected to the connector according to the present embodiment.

FIG. 11 is a perspective view of an outer shell part of the inner housing according to the embodiment, FIG. 12 is a perspective view of a holding body of the inner housing according to the embodiment, FIG. 13 is a plan view of the holding body according to the embodiment, FIG. 14 is a side view of the holding body according to the embodiment, FIG. 15 is a plan view of the inner housing according to the embodiment, FIG. 16 is a perspective view illustrating the outer housing to be inserted into a hole part, FIG. 17 is a perspective view illustrating fastening of bolts to a wall part, FIG. 18 is a front view illustrating the outer housing fixed to the wall part, and FIG. 19 is a perspective view illustrating a counterpart connector to be connected to the connector according to the present embodiment.

Figure 20:
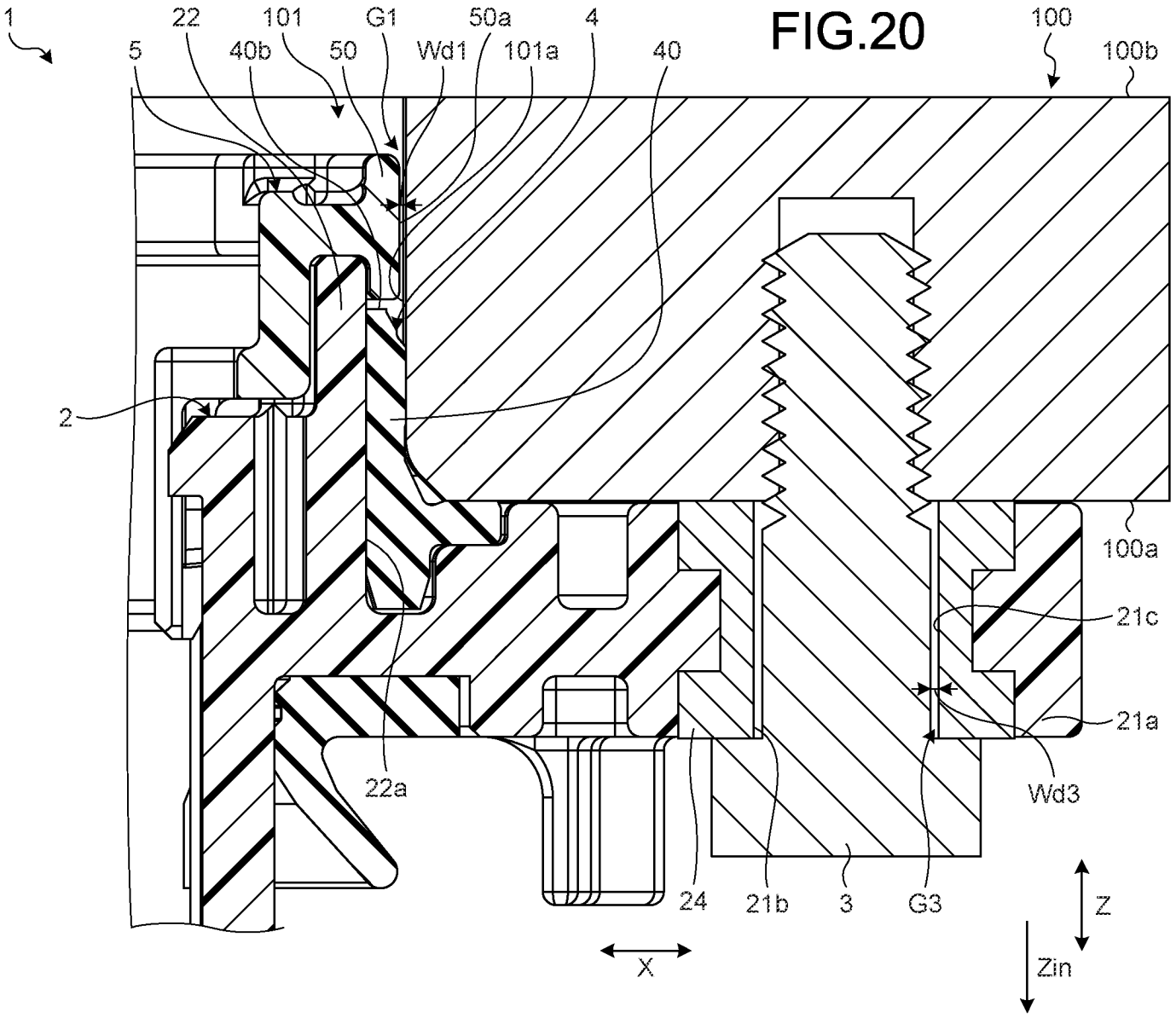
FIG. 20 is a sectional view of the outer housing fixed to the wall part, the sealing member, and the holder.
Figure 21:
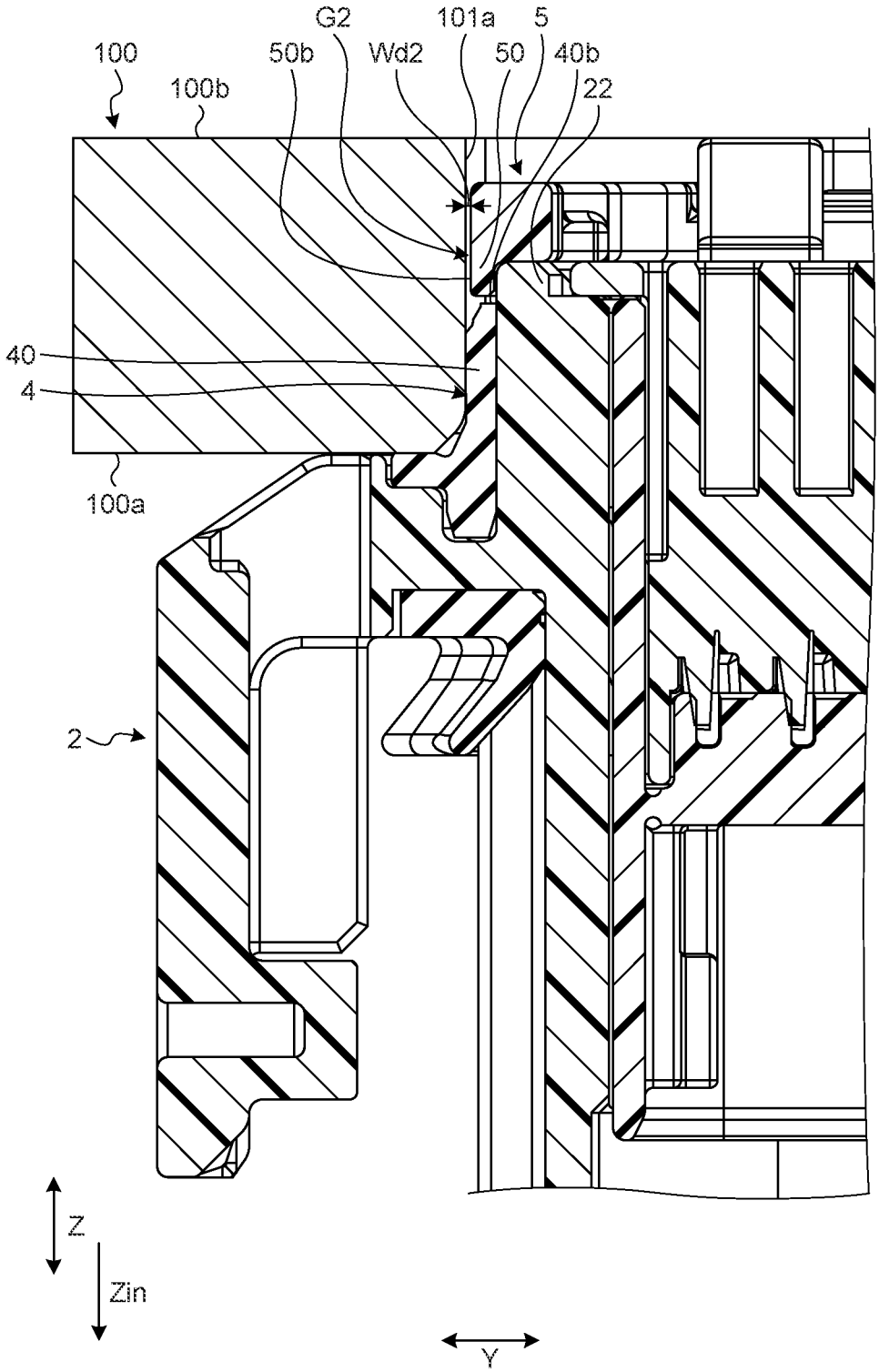
FIG. 21 is a cross-sectional view of the outer housing fixed to the wall part, the sealing member, and the holder.
Figure 22:
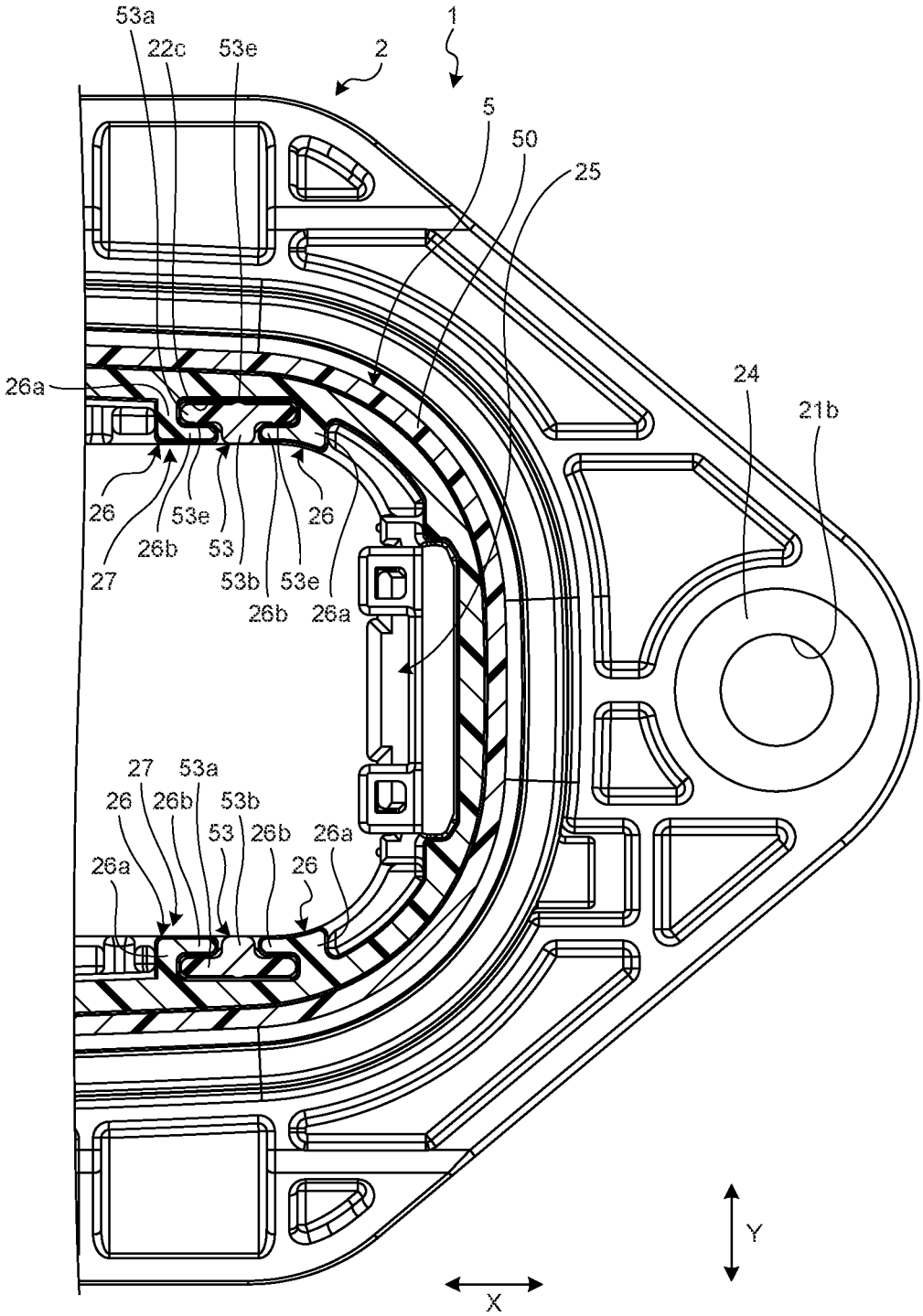
FIG. 22 is a sectional view of the outer housing and the holder.

FIG. 20 and FIG. 21 are a sectional view and a cross-sectional view of the outer housing fixed to the wall part, the sealing member, and the holder, and FIG. 22 is a sectional view of the outer housing and the holder. FIG. 20 illustrates an XX-XX section in FIG. 18. FIG. 21 illustrates an XXI-XXI cross section in FIG. 18.

Figure 2:
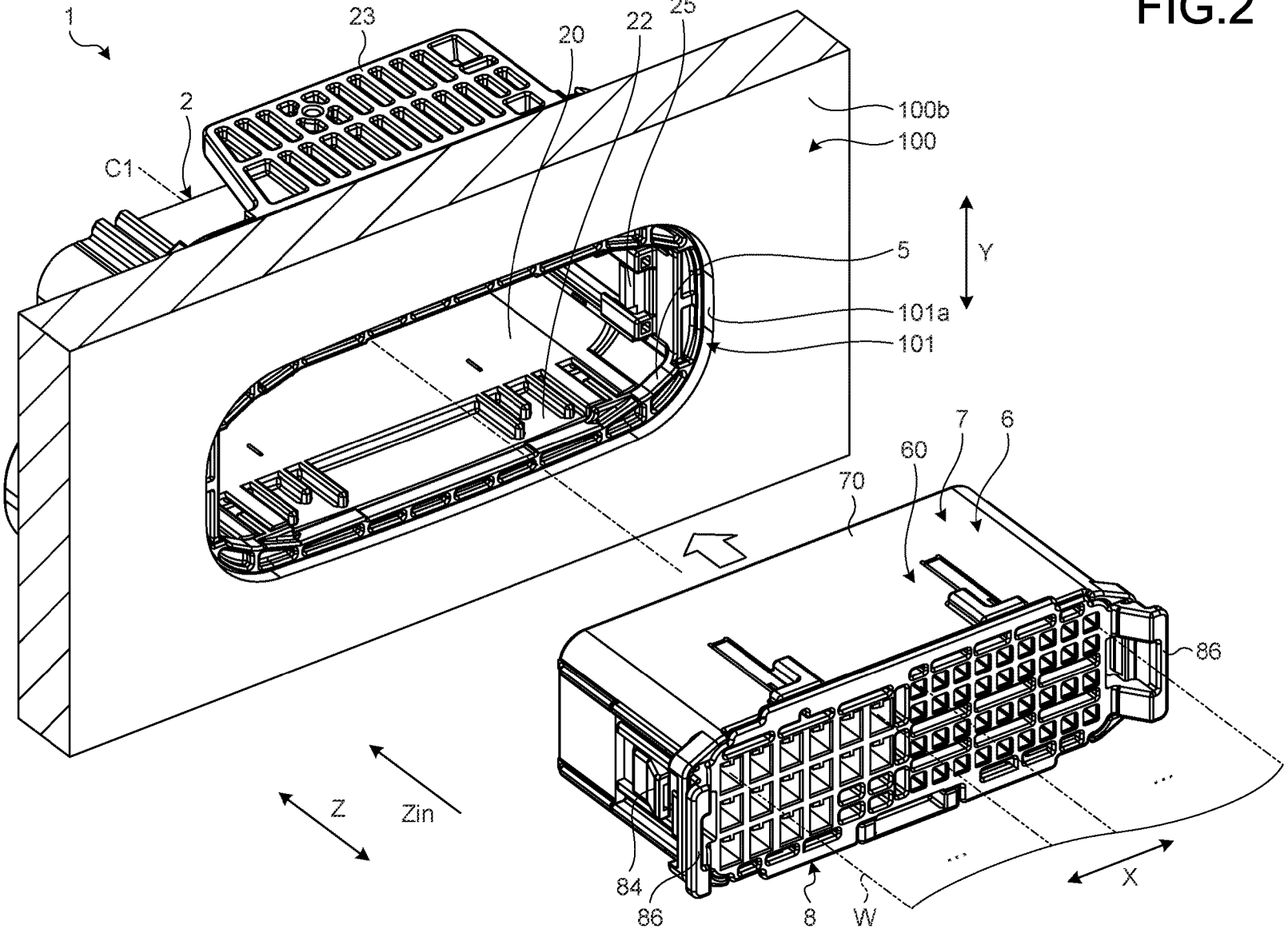
FIG. 2 is a diagram illustrating an inner housing to be inserted into an outer housing.

As illustrated in FIG. 1 and FIG. 2, a connector 1 according to the present embodiment is fixed to a wall part 100. The wall part 100 is, for example, part of a housing of a device mounted on a vehicle. The wall part 100 may be a wall part constituting a housing of an inverter or a motor. The wall part 100 includes a first surface 100*a* and a second surface 100*b*. The first surface 100*a* is, for example, an outer surface of the housing. The second surface 100*b* is, for example, an inner surface of the housing. As illustrated in FIG. 2, the wall part 100 includes a hole part 101. The hole part 101 passes through the wall part 100, and opens on each of the first surface 100*a* and the second surface 100*b*. The shape of the hole part 101 according to the present embodiment is a rectangle having four corners that are rounded in a circular arc shape.

As illustrated in FIG. 3, the connector 1 includes an outer housing 2, bolts 3, a sealing member 4, a holder 5, and an inner housing 6. The outer housing 2 includes a main body 20, a flange part 21, an inserting part 22, and a pair of opposed wall parts 23 and 23. The main body 20, the flange part 21, the inserting part 22, and the opposed wall parts 23 are integrally formed by an insulative synthetic resin, for example. The main body 20 has a tubular shape both ends of which are opened, and houses the inner housing 6. A sectional shape of the main body 20 is a rectangle having four corners that are rounded in a circular arc shape.

In the following description, a longitudinal direction on a section of the main body 20 is referred to as a "first direction X", and a lateral direction on the section of the main body 20 is referred to as a "second direction Y". The first direction X and the second direction Y are orthogonal to each other. A direction along a center axis C1 of the main body 20 is referred to as an "axis direction Z". The first direction X and the second direction Y are orthogonal to the axis direction Z. The inner housing 6 is inserted into the outer housing 2 along the axis direction Z. Thus, the first direction X and the second direction Y are orthogonal to an insertion direction Zin of the inner housing 6 with respect to the outer housing 2.

The flange part 21 is connected to one end in the axis direction Z of the main body 20. The flange part 21 projects from an outer surface of the main body 20 in a direction orthogonal to the axis direction Z. The flange part 21 is formed in an annular shape to surround the outer surface of the main body 20.

The inserting part 22 is a portion to be inserted into the hole part 101 of the wall part 100. The inserting part 22 projects from the flange part 21 toward an opposite side of the main body 20 side. The shape of the inserting part 22 is a tubular shape. A sectional shape of a section orthogonal to the axis direction Z of the exemplified inserting part 22 is a rectangle the four corners of which are rounded in a circular arc shape. An outer surface 22*a* of the inserting part 22 is a smooth surface. A pair of engaging parts 25 is disposed on an inner surface of the inserting part 22. The pair of engaging parts 25 is opposed to each other in the first direction X. The engaging parts 25 are engaged with the holder 5 to hold the holder 5.

As illustrated in FIG. 5, guides 27 for positioning the holder 5 are disposed on the inner surface of the inserting part 22. The guides 27 are disposed on a first inner surface 22*c* as a surface along the first direction X. Two guides 27 are disposed on the first inner surface 22*c*. The two guides 27 are disposed at both end parts in the first direction X of the first inner surface 22*c*.

The guide 27 includes a pair of guide walls 26 and 26. The guide wall 26 includes a base 26*a* and an opposed part 26*b*. The base 26*a* projects from the first inner surface 22*c* toward the second direction Y. The opposed part 26*b* projects from a distal end of one base 26*a* toward the other base 26*a* along the first direction X. Distal ends of two opposed parts 26*b* are opposed to each other in the first direction X. The opposed part 26*b* is opposed to the first inner surface 22*c* in the second direction Y. The guide 27 guides a projecting part 53 (refer to FIG. 9) of the holder 5. The guide 27 regulates relative movement of the projecting part 53 with respect to the inserting part 22.

The outer housing 2 includes a pair of fixing parts 21*a*. The fixing parts 21*a* are portions at both ends in the first direction X of the flange part 21. That is, the pair of fixing parts 21*a* is positioned on both sides in the first direction X across the inserting part 22. The fixing part 21*a* is a portion to be fixed to the first surface 100*a* of the wall part 100. A through hole 21*b*, into which the bolt 3 is inserted is disposed in the fixing part 21*a*. One through hole 21*b* is disposed in each of the fixing parts 21*a*.

The through hole 21*b* according to the present embodiment passes through a collar 24. The collar 24 is a member having a cylindrical shape, and is made of metal, for example. The collar 24 is integrated with the flange part 21 by insert molding and the like. That is, the collar 24 constitutes the fixing part 21*a* together with surrounding resins. The through hole 21*b* passes through the collar 24 along the axis direction Z. A sectional shape of the through hole 21*b* is a circle.

The two through holes 21*b* may be positioned on the same line in the first direction X. For example, the through hole 21*b* of one of the fixing parts 21*a* and the through hole 21*b* of the other one of the fixing parts 21*a* may be positioned on a virtual line L1 along the first direction X.

The pair of opposed wall parts 23 and 23 project from the flange part 21 along the axis direction Z. A projecting direction of the opposed wall part 23 with respect to the flange part 21 is the same as a projecting direction of the main body 20 with respect to the flange part 21. The pair of opposed wall parts 23 and 23 is opposed to each other in the second direction Y across the main body 20. A housing 201 of a counterpart connector 200 (refer to FIG. 19) is inserted between the opposed wall part 23 and the main body 20. The opposed wall part 23 includes a projection 23*a* having a round column shape. The projection 23*a* projects toward the main body 20 along the second direction Y.

The sealing member 4 is mounted on the outer surface 22*a* of the inserting part 22 to seal between the inserting part 22 and the wall part 100. The sealing member 4 is formed by a resin having elasticity such as rubber. As illustrated in FIG. 7, for example, the shape of the sealing member 4 is an annular shape. The sealing member 4 includes a first sealing part 40 and a second sealing part 41. The first sealing part 40 is a portion functioning as an axis seal. The second sealing part 41 is a portion functioning as a surface seal.

The shape of the first sealing part 40 is a tubular shape having a center axis along the axis direction Z. The first sealing part 40 is mounted on the outer surface 22*a* of the inserting part 22. That is, the inserting part 22 is inserted into the first sealing part 40. A lip 40*a* is formed on an outer surface of the first sealing part 40. The lip 40*a* is disposed over the entire circumference of the outer surface of the first sealing part 40. The first sealing part 40 seals between the outer surface 22*a* of the inserting part 22 and a wall surface 101*a* of the hole part 101.

The second sealing part 41 projects from the outer surface of the first sealing part 40 toward a direction orthogonal to the axis direction Z. The shape of the second sealing part 41 is an annular shape. That is, the second sealing part 41 is disposed over the entire circumference of the outer surface of the first sealing part 40. The second sealing part 41 seals between the flange part 21 of the outer housing 2 and the first surface 100*a* of the wall part 100.

The holder 5 is a member that is fixed to a distal end part of the inserting part 22. The holder 5 has a function of holding the sealing member 4, a function of protecting the sealing member 4, and a function of suppressing eccentricity of the inserting part 22 with respect to the hole part 101. As illustrated in FIG. 9 and FIG. 10, the holder 5 includes an abutting part 50, an annular part 51, engaging parts 52, and projecting parts 53. The abutting part 50, the annular part 51, the engaging parts 52, and the projecting parts 53 are integrally formed by an insulative synthetic resin, for example.

The abutting part 50 is a portion that abuts on the wall surface 101*a* of the hole part 101 to regulate relative movement of the inserting part 22 with respect to the hole part 101. The exemplified abutting part 50 has a tubular shape, and is configured to cover the outer surface 22*a* of the inserting part 22. The shape of the abutting part 50 in a case of being viewed from the axis direction Z is a rectangle having four rounded corners. The abutting part 50 includes a first abutting surface 50*a* and a second abutting surface 50*b*.

The first abutting surface 50*a* is a surface facing the first direction X in a state in which the holder 5 is fixed to the inserting part 22. Thus, the first abutting surface 50*a* is opposed to the wall surface 101*a* of the hole part 101 in the first direction X. The first abutting surface 50*a* is, for example, a plane.

The second abutting surface 50*b* is a surface facing the second direction Y in a state in which the holder 5 is fixed to the inserting part 22. Thus, the second abutting surface 50*b* is opposed to the wall surface 101*a* of the hole part 101 in the second direction Y. The second abutting surface 50*b* is, for example, a curved surface that is slightly curved outward. The second abutting surface 50*b* may be substantially a flat surface.

The abutting part 50 includes curved surfaces 50*c* that connect the first abutting surface 50*a* with the second abutting surface 50*b*. The curved surfaces 50*c* are disposed at four corner parts of the abutting part 50. The curved surface 50*c* is curved outward, and has a substantially circular ark shape, for example.

The annular part 51 is a portion opposed to a distal end surface 22*b* of the inserting part 22. The shape of the annular part 51 in a case of being viewed from the axis direction Z is a rectangle having four rounded corners. The annular part 51 is formed to cover and hide the distal end surface 22*b*. The abutting part 50 projects from an opposed surface 51*a* of the annular part 51 along the axis direction Z. The opposed surface 51*a* is a surface of the annular part 51 on a side opposed to the distal end surface 22*b*. The abutting part 50 projects from an outer edge of the opposed surface 51*a* toward the axis direction Z.

The engaging part 52 projects from the opposed surface 51*a* of the annular part 51 toward the axis direction Z. The engaging parts 52 are respectively disposed on two short side portions included in the annular part 51. The engaging part 52 includes a pair of flexible arms 52*a*. The pair of arms 52*a* are arranged side by side along the second direction Y. A pawl 52*b* is formed on a distal end part of the arm 52*a*. The pawl 52*b* is engaged with the engaging part 25 of the inserting part 22, and is locked by the engaging part 25.

The projecting part 53 projects from the opposed surface 51*a* of the annular part 51 toward the axis direction Z. The projecting parts 53 are respectively disposed on two long side portions included in the annular part 51. A pair of the projecting parts 53 is disposed on one long side portion. The pair of the projecting parts 53 is disposed on both ends of the long side portion. The projecting part 53 includes a main part 53*a* and a projection 53*b*. The shape of the main part 53*a* is a rectangular flat plate shape. A principal plane of the main part 53*a* faces the second direction Y. That is, the main part 53*a* extends in a direction orthogonal to the second direction Y.

The main part 53*a* includes a first surface 53*c* and a second surface 53*d*. The first surface 53*c* is a surface facing an inner side of the holder 5 of two principal planes included in the main part 53*a*. The second surface 53*d* is a surface facing an outer side of the holder 5. The projection 53*b* projects from the first surface 53*c* of the main part 53*a*. The projection 53*b* extends along the axis direction Z from a base end to a distal end of the main part 53*a*. Squeezing ribs 53*e* extending along the axis direction Z are disposed on the first surface 53*c* and the second surface 53*d*. The squeezing rib 53*e* can be plastically deformed when the projecting part 53 is inserted into the guide 27. The squeezing rib 53*e* suppress play between the projecting part 53 and the guide 27.

The inner housing 6 according to the present embodiment includes an outer shell part 7 illustrated in FIG. 11, and a holding body 8 illustrated in FIG. 12 to FIG. 14. As illustrated in FIG. 11, the outer shell part 7 includes an external wall part 70 having a tubular shape, and a partition wall 71. The external wall part 70 and the partition wall 71 are integrally formed by an insulative synthetic resin, for example. A sectional shape of the external wall part 70 on a section orthogonal to the axis direction Z is a rectangle having four rounded corners. The external wall part 70 includes a pair of first wall parts 70*a* and 70*a*, and a pair of second wall parts 70*b* and 70*b*. The pair of first wall parts 70*a* and 70*a* extends along the first direction X, and is opposed to each other in the second direction Y. The pair of second wall parts 70*b* and 70*b* extends along the second direction Y, and is opposed to each other in the first direction X.

The partition wall 71 is orthogonal to the axis direction Z, and partitions a space part surrounded by the external wall part 70. The partition wall 71 is connected to the pair of first wall parts 70*a* and 70*a* and the pair of second wall parts 70*b* and 70*b*. The partition wall 71 includes a plurality of through holes 71*a*. A terminal of the connector 1 is inserted into the through hole 71*a*. The terminal held by the connector 1 is, for example, a male terminal.

A slit 73 extending along the axis direction Z is formed in the first wall part 70*a*. The slit 73 extends from a rear end in the insertion direction Zin of the first wall part 70*a* toward the insertion direction Zin. Two slits 73 are disposed in one first wall part 70*a*. A notch 74 opening toward a rear side in the insertion direction Zin is formed on the second wall part 70*b*.

Engaging parts 72 are disposed at a rear end in the insertion direction Zin of the external wall part 70. The engaging parts 72 are disposed at both ends in the first direction X of the external wall part 70. The engaging part 72 includes an arch part 72*a* and a projection 72*b*. The arch part 72*a* connects the pair of first wall parts 70*a* and 70*a* across the notch 74. The projection 72*b* projects from a center part of the arch part 72*a* toward the insertion direction Zin.

As illustrated in FIG. 12, the holding body 8 of the inner housing 6 includes a main body 80 and a projecting part 81. The main body 80 and the projecting part 81 are, for example, integrally formed by an insulative synthetic resin. The main body 80 is a portion to be engaged with the outer shell part 7. The shape of the exemplified main body 80 is a substantially rectangular parallelepiped shape. The main body 80 includes a plurality of cavities 80*d*. The cavity 80*d* passes through the main body 80 along the axis direction Z. The terminal of the connector 1 is inserted into the cavity 80*d* to be held by the cavity 80*d*.

An outer wall surface of the main body 80 includes a pair of first wall surfaces 80*a* and 80*a*, and a pair of second wall surfaces 80*b* and 80*b*. The first wall surface 80*a* is a wall surface extending along the first direction X, and faces the second direction Y. The second wall surface 80*b* is a wall surface extending along the second direction Y, and faces the first direction X. A plate part 82 is disposed at a rear end in the insertion direction Zin of the main body 80. The plate part 82 projects from the first wall surface 80*a* toward the second direction Y. Ribs 83 are formed on the first wall surface 80*a*. The ribs 83 are connected to the plate part 82, and extend along the axis direction Z. The two ribs 83 are disposed on each first wall surface 80*a*. The rib 83 is inserted into the slit 73 of the outer shell part 7.

A flexible arm 84 is disposed on each second wall surface 80*b*. The arm 84 is connected to a front side portion in the insertion direction Zin of the second wall surface 80*b*. The arm 84 extends along the axis direction Z toward a rear side in the insertion direction Zin. The arm 84 is engaged with the engaging part 25 (refer to FIG. 5) of the outer housing 2 when the inner housing 6 is inserted into the outer housing 2. When the inner housing 6 and the outer housing 2 are completely engaged with each other, the arm 84 is locked by the engaging part 25. The engaging part 25 regulates movement of the inner housing 6 in a direction of slipping out of the outer housing 2.

The projecting part 81 projects from the main body 80 toward a rear side in the insertion direction Zin. One projecting part 81 is disposed for each of both ends in the first direction X of the main body 80. The projecting part 81 includes a pair of bases 85 and 85, and an operation part 86. The base 85 projects from a rear end 80*c* of the main body 80 toward a rear side in the insertion direction Zin. The base 85 is connected to the second wall surface 80*b*, and extends in a direction inclined with respect to the second wall surface 80*b*. That is, the base 85 is inclined to become more distant from the second wall surface 80*b* toward a rear side in the insertion direction Zin.

The operation part 86 connects the pair of bases 85 and 85 along the second direction Y. Both ends of the operation part 86 in the second direction Y are connected to end parts of the bases 85. The shape of the operation part 86 is a flat plate shape or a rectangular column shape. The operation part 86 projects and extends from a rear end 85*a* in the insertion direction Zin of the base 85 toward the first direction X. An extending direction of the operation part 86 is a direction to be more distant from the main body 80 along the first direction X. As illustrated in FIG. 13, for example, the operation part 86 includes a rear end surface 86*a* facing a rear side in the insertion direction Zin, and a side surface 86*b*. The side surface 86*b* faces an opposite side of a center axis C2 side of the main body 80 in the first direction X.

The operation part 86 is formed to be easily held by an operator. For example, at the time of assembling the inner housing 6 to the outer housing 2, the operator holds a pair of the operation parts 86. The operator may sandwich the pair of operation parts 86 by one hand, or may hold the two operation parts 86 by different hands. Additionally, at the time of inserting the inner housing 6 into the outer housing 2, the operator can push the rear end surface 86*a*. The rear end surface 86*a* is a plane, so that the operator can easily push the rear end surface 86*a*. The pair of the operation parts 86 is positioned on both ends in the longitudinal direction of the main body 80. Thus, the operator can uniformly apply pressing force to the inner housing 6 via two rear end surfaces 86*a*.

FIG. 15 illustrates the inner housing 6 to which the outer shell part 7 and the holding body 8 are assembled. The external wall part 70 of the outer shell part 7 and the main body 80 of the holding body 8 constitute a main body 60 of the inner housing 6. An electric wire W connected to the terminal projects from the rear end 80*c* of the holding body 8 toward the outside. The operation part 86 projects from the main body 60 toward a rear side in the insertion direction Zin. The operation part 86 projects from the main body 60 along the first direction X. Thus, the operation part 86 hardly interferes with the electric wire W. The operator can easily assemble the inner housing 6 to the outer housing 2 while holding the operation parts 86.

The following describes an assembling method for the connector 1 according to the present embodiment. First, as illustrated in FIG. 16, the outer housing 2 is attached to the wall part 100. The inserting part 22 of the outer housing 2 has the sealing member 4 and the holder 5 attached thereto. The operator inserts the inserting part 22 into the hole part 101. The operator inserts the inserting part 22 into the hole part 101 to reach a position where the fixing part 21*a* abuts on the first surface 100*a*, for example.

Next, as illustrated in FIG. 17, the outer housing 2 is fixed to the wall part 100 by the bolts 3. The bolt 3 is inserted into the through hole 21*b* of the outer housing 2, and is screwed into a screw hole 102 of the wall part 100. The fixing parts 21*a* of the outer housing 2 are fastened to the wall part 100 by the two bolts 3.

Next, as illustrated in FIG. 2, the inner housing 6 is inserted into the outer housing 2. The inner housing 6 is inserted into the hole part 101 and the outer housing 2 from the second surface 100*b* side. When the inner housing 6 is inserted into the outer housing 2 to reach a completely engaged position, the flexible arm 84 is engaged with the engaging part 25. When the inner housing 6 is completely engaged with the outer housing 2, assembly of the connector 1 according to the embodiment is completed. FIG. 18 illustrates the connector 1 after the inner housing 6 is assembled to the outer housing 2.

FIG. 19 illustrates the counterpart connector 200 corresponding to the connector 1 according to the present embodiment. As illustrated in FIG. 19, the counterpart connector 200 is connected to the connector 1 that is fixed to the wall part 100. The counterpart connector 200 is what is called a lever-type connector, and includes the housing 201 and a lever 202. The lever 202 is coupled to the housing 201, and supported by the housing 201 in a rotatable manner. The lever 202 includes a guide groove 203.

When the housing 201 is engaged with the inner housing 6, the projection 23*a* is inserted into the guide groove 203. When the lever 202 is rotated thereafter, the guide groove 203 draws the projection 23*a* to completely engage the housing 201 with the inner housing 6. The counterpart connector 200 can completely engage the housing 201 with the inner housing 6 with small force using the principle of the lever.

As described below, the connector 1 according to the present embodiment is configured to be able to suppress eccentricity of the inserting part 22 with respect to the hole part 101. FIG. 20 and FIG. 21 illustrate the inserting part 22 inserted into the hole part 101, the sealing member 4, and the holder 5. In FIG. 20 and FIG. 21, the inserting part 22, the sealing member 4, and the holder 5 are positioned concentrically with the hole part 101. In the following description about the inserting part 22, a position concentric with the hole part 101 is simply referred to as a "concentric position".

The holder 5 according to the present embodiment is configured to have gaps G1 and G2 between itself and the wall surface 101*a* of the hole part 101 in a state in which the inserting part 22 is positioned concentrically with the hole part 101. As illustrated in FIG. 20, the gap G1 is disposed between the first abutting surface 50*a* and the wall surface 101*a* of the hole part 101. As illustrated in FIG. 21, the gap G2 is disposed between the second abutting surface 50*b* and the wall surface 101*a* of the hole part 101. As described below, a width Wd1 of the gap G1 and a width Wd2 of the gap G2 are defined to limit a relative movement range of the inserting part 22 with respect to the hole part 101.

As illustrated in FIG. 20, a gap G3 is present between the bolt 3 and a wall surface 21*c* of the through hole 21*b*. In FIG. 20, the bolt 3 is positioned concentrically with the through hole 21*b*. A width Wd3 of the gap G3 in the first direction X is, for example, defined to absorb tolerances of respective parts of the outer housing 2 and the like. Although not illustrated, a gap is present between the wall surface 21*c* and the bolt 3 also in the second direction Y. The gap between the wall surface 21*c* and the bolt 3 in the second direction Y is referred to as a "gap G4", and a width of the gap G4 is referred to as a "width Wd4". A value of the width Wd4 of the gap G4 in the second direction Y is, for example, the same as a value of the width Wd3.

In the present embodiment, the gap G1 between the first abutting surface 50*a* and the wall surface 101*a* is narrower than the gap G3 between the wall surface 21*c* and the bolt 3. That is, a movable range of the inserting part 22 in the first direction X is narrowed. In a case in which the holder 5 is not provided, the movable range of the inserting part 22 in the first direction X is determined corresponding to the width Wd3 of the gap G3. That is, the inserting part 22 is allowed to move from the concentric position in a range of the width Wd3 along the first direction X.

On the other hand, the connector 1 according to the present embodiment includes the holder 5 that regulates eccentricity of the inserting part 22. The first abutting surface 50*a* of the holder 5 abuts on the wall surface 101*a* of the hole part 101 so as to limit relative movement of the inserting part 22 with respect to the hole part 101. The movable range of the inserting part 22 in the first direction X is determined corresponding to the width Wd1 of the gap G1. In this case, the inserting part 22 is allowed to move from the concentric position in a range of the width Wd1. Thus, an amount of eccentricity of the inserting part 22 in the first direction X is reduced as compared with the case in which the holder 5 is not provided.

The gap G2 between the second abutting surface 50*b* and the wall surface 101*a* is narrower than the gap G4 between the wall surface 21*c* and the bolt 3. That is, the movable range of the inserting part 22 in the second direction Y is narrowed. In a case in which the holder 5 is not provided, the movable range of the inserting part 22 in the second direction Y is determined corresponding to the width Wd4 of the gap G4. That is, the inserting part 22 is allowed to move from the concentric position in a range of the width Wd4 along the second direction Y.

On the other hand, the second abutting surface 50*b* of the holder 5 abuts on the wall surface 101*a* of the hole part 101 so as to limit relative movement of the inserting part 22 with respect to the hole part 101. The movable range of the inserting part 22 in the second direction Y is determined corresponding to the width Wd2 of the gap G2. In this case, the inserting part 22 is allowed to move from the concentric position in a range of the width Wd2. Thus, an amount of eccentricity of the inserting part 22 in the second direction Y is reduced as compared with the case in which the holder 5 is not provided.

In the connector 1 according to the present embodiment, as illustrated in FIG. 22, eccentricity of the holder 5 with respect to the inserting part 22 is suppressed. As illustrated in FIG. 22, the projecting part 53 of the holder 5 is inserted into the guide 27 of the outer housing 2. The main part 53*a* of the projecting part 53 is held between the first inner surface 22*c* and the opposed part 26*b* of the guide 27. That is, the guide 27 positions the holder 5 in the second direction Y, and regulates relative movement of the abutting part 50 with respect to the inserting part 22. The main part 53*a* of the projecting part 53 is held between the bases 26*a* of the guide 27. That is, the guide 27 positions the holder 5 in the first direction X, and regulates relative movement of the abutting part 50 with respect to the inserting part 22. With this configuration, an amount of eccentricity of the inserting part 22 with respect to the hole part 101 is reduced.

The connector 1 according to the present embodiment can suppress eccentricity of the inserting part 22 with respect to the hole part 101, and can suppress deterioration of waterproof performance of the sealing member 4. As the eccentricity of the inserting part 22 is suppressed, imbalance in a compression rate of the sealing member 4 is suppressed, and the sealing member 4 is compressed more uniformly. As a result, the waterproof performance of the sealing member 4 is improved.

The holder 5 according to the present embodiment is configured to protect the sealing member 4 at the time when the outer housing 2 is inserted into the hole part 101. As illustrated in FIG. 20, for example, the abutting part 50 of the holder 5 is opposed to an end face 40*b* of the sealing member 4 in the axis direction Z. A thickness of the abutting part 50 is larger than a thickness of the end face 40*b*. Thus, at the time when the inserting part 22 is inserted into the hole part 101, the abutting part 50 protects the end face 40*b* of the sealing member 4 not to interfere with an edge of the hole part 101. Accordingly, the holder 5 can prevent deviation from being caused due to interference of the sealing member 4. The holder 5 also has a function of preventing the sealing member 4 from falling out of the outer housing 2.

As described above, the connector 1 according to the embodiment includes the bolt 3, the outer housing 2, the sealing member 4, and the holder 5. The outer housing 2 includes the fixing part 21*a* including the through hole 21*b*, and the inserting part 22 having a tubular shape. The fixing part 21*a* is a portion to be fixed to the wall part 100 by the bolt 3 that is inserted into the through hole 21*b*. The inserting part 22 is a portion projecting from the fixing part 21*a* to be inserted into the hole part 101 of the wall part 100. The sealing member 4 is mounted on the outer surface 22*a* of the inserting part 22 to seal between the inserting part 22 and the hole part 101.

The holder 5 includes the abutting part 50, and is fixed to the distal end part of the inserting part 22. The abutting part 50 is a portion positioned between the outer surface 22*a* of the inserting part 22 and the hole part 101. The abutting part 50 abuts on the wall surface 101*a* of the hole part 101 so as to limit relative movement of the inserting part 22 with respect to the hole part 101. The gap between the wall surface 101*a* of the hole part 101 and the abutting part 50 is narrower than the gap between the wall surface 21*c* of the through hole 21*b* and the bolt 3. For example, the gap G1 between the first abutting surface 50*a* of the abutting part 50 and the wall surface 101*a* of the hole part 101 is narrower than the gap G3 between the wall surface 21*c* of the through hole 21*b* and the bolt 3. The connector 1 according to the present embodiment can suppress eccentricity of the inserting part 22 with respect to the hole part 101, and can suppress deterioration of sealing performance of the sealing member 4.

The abutting part 50 according to the present embodiment includes the first abutting surface 50*a* and the second abutting surface 50*b*. The first abutting surface 50*a* is a surface opposed to the wall surface 101*a* of the hole part 101 in the first direction X. The second abutting surface 50*b* is a surface opposed to the wall surface 101*a* of the hole part 101 in the second direction Y. The first direction X and the second direction Y are orthogonal to each other. In the first direction X, the gap G1 between the wall surface 101*a* of the hole part 101 and the first abutting surface 50*a* is narrower than the gap G3 between the wall surface 21*c* of the through hole 21*b* and the bolt 3. In the second direction Y, the gap G2 between the wall surface 101*a* of the hole part 101 and the second abutting surface 50*b* is narrower than the gap G4 between the wall surface 21*c* of the through hole 21*b* and the bolt 3. With this configuration, eccentricity of the inserting part 22 with respect to the hole part 101 is suppressed in two directions, that is, the first direction X and the second direction Y.

The abutting part 50 according to the present embodiment has a tubular shape, and covers the outer surface 22*a* of the inserting part 22. By causing the shape of the abutting part 50 to be the tubular shape, eccentricity of the inserting part 22 with respect to the hole part 101 is preferably suppressed. Additionally, by causing the abutting part 50 to have the tubular shape, the sealing member 4 can be protected by the abutting part 50.

The abutting part 50 according to the present embodiment is opposed to the end face 40*b* of the sealing member 4 in the axis direction Z of the inserting part 22. The thickness of the abutting part 50 is larger than the thickness of the end face 40*b* of the sealing member 4. With this configuration, the end face 40*b* of the sealing member 4 can be protected by the abutting part 50.

The holder 5 according to the present embodiment includes the annular part 51 having an annular shape, the engaging part 52, and the projecting part 53. The annular part 51 is a portion opposed to the distal end surface 22*b* of the inserting part 22. The engaging part 52 is a portion that is inserted into the inserting part 22 to be engaged with the inserting part 22. The projecting part 53 is a portion that projects from the annular part 51, and is positioned by the inserting part 22. As the projecting part 53 is positioned by the inserting part 22, eccentricity of the inserting part 22 with respect to the hole part 101 is hardly caused.

The inserting part 22 according to the present embodiment includes the guide 27 that regulates relative movement of the projecting part 53 with respect to the inserting part 22 in the first direction X and the second direction Y. With this configuration, eccentricity of the inserting part 22 with respect to the hole part 101 is hardly caused.

The shapes of the inserting part 22 and the holder 5, the position of the holder 5, and the like are not limited to the shapes and the positions exemplified in the embodiment. For example, the shape of the abutting part 50 of the holder 5 is not limited to the tubular shape. The shape of the abutting part 50 may be any shape that can limit relative movement of the inserting part 22 with respect to the hole part 101 by abutting on the wall surface 101*a*.

The number of the bolts 3 for fixing the outer housing 2 is not limited to two. The outer housing 2 may be fixed to the wall part 100 by three or more bolts 3.

Pieces of content disclosed in the embodiment and the modification described above can be appropriately combined to be executed.

The connector according to the present embodiment includes the housing including the inserting part having a tubular shape, the sealing member mounted on the outer surface of the inserting part, and the holder including the abutting part that is positioned between the outer surface of the inserting part and the hole part. The gap between the wall surface of the hole part and the abutting part is narrower than the gap between the wall surface of the through hole of the housing and the bolt. The abutting part can suppress eccentricity of the inserting part with respect to the hole part. Accordingly, the connector according to the present embodiment exhibits an effect of suppressing deterioration of sealing performance of the sealing member.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A connector configured to regulate movement relative to a wall part, the connector comprising:

a bolt;

a housing including a fixing part having a through hole into which the bolt is inserted, the fixing part being fixed to a wall part by the bolt, and an inserting part having a tubular shape that projects from the fixing part to be inserted into a hole part of the wall part;

a sealing member that is mounted on an outer surface of the inserting part to seal between the inserting part and the hole part; and a holder including an abutting part that is positioned between an outer surface of the inserting part and the hole part, the holder being fixed to a distal end part of the inserting part, wherein the abutting part abuts on a wall surface of the hole part so as to limit relative movement of the inserting part with respect to the hole part, and a gap between the wall surface of the hole part and the abutting part is narrower than a gap between a wall surface of the through hole and the bolt.

2. The connector according to claim 1, wherein the abutting part includes a first abutting surface opposed to the wall surface of the hole part in a first direction, and a second abutting surface opposed to the wall surface of the hole part in a second direction, the first direction and the second direction are orthogonal to each other, the gap between the wall surface of the hole part and the first abutting surface is narrower than the gap between the wall surface of the through hole and the bolt in the first direction, and the gap between the wall surface of the hole part and the second abutting surface is narrower than the gap between the wall surface of the through hole and the bolt in the second direction.

3. The connector according to claim 2, wherein the housing includes a pair of the fixing parts, and the pair of the fixing parts is positioned on both sides in the first direction across the inserting part.

4. The connector according to claim 3, wherein the abutting part has a tubular shape, and covers the outer surface of the inserting part.

5. The connector according to claim 2, wherein the abutting part has a tubular shape, and covers the outer surface of the inserting part.

6. The connector according to claim 1, wherein the abutting part has a tubular shape, and covers the outer surface of the inserting part.

7. The connector according to claim 6, wherein the abutting part is opposed to an end face of the sealing member in an axis direction of the inserting part, and a thickness of the abutting part is larger than a thickness of the end face of the sealing member.

8. The connector according to claim 7, wherein the holder includes an annular part having an annular shape opposed to a distal end surface of the inserting part, an engaging part that projects from the annular part and is inserted into the inserting part so as to be engaged with the inserting part, and a projecting part that projects from the annular part and is positioned by the inserting part.

9. The connector according to claim 6, wherein the holder includes an annular part having an annular shape opposed to a distal end surface of the inserting part, an engaging part that projects from the annular part and is inserted into the inserting part so as to be engaged with the inserting part, and a projecting part that projects from the annular part and is positioned by the inserting part.

10. The connector according to claim 9, wherein the inserting part includes a guide that regulates relative movement of the projecting part with respect to the inserting part in two directions that are orthogonal to each other.

* * * * *